US012746951B2

(12) United States Patent
Gavoty et al.

(10) Patent No.: US 12,746,951 B2
(45) Date of Patent: Sep. 29, 2026

(54) CORNERING STRUCTURE AND CABLEWAY INSTALLATION COMPRISING THIS STRUCTURE

(71) Applicants: EIFFAGE METAL, Velizy-Villacoublay (FR); POMA, Voreppe (FR)

(72) Inventors: Simon Gavoty, Paris (FR); Stephane Coudurier, Saint Etienne de Crossey (FR)

(73) Assignee: POMA, Voreppe (FR)

( * ) Notice: Subject to any disclaimer, the term of this patent is extended or adjusted under 35 U.S.C. 154(b) by 1291 days.

(21) Appl. No.: 17/292,486

(22) PCT Filed: Nov. 7, 2019

(86) PCT No.: PCT/EP2019/080607
§ 371 (c)(1),
(2) Date: Dec. 13, 2021

(87) PCT Pub. No.: WO2020/099247
PCT Pub. Date: May 22, 2020

(65) Prior Publication Data

US 2022/0105964 A1 Apr. 7, 2022

(30) Foreign Application Priority Data

Nov. 12, 2018 (EP) ..... 18205797

(51) Int. Cl.
*B61B 12/02* (2006.01)
*B61B 7/02* (2006.01)
(Continued)

(52) U.S. Cl.
CPC ..... *B61B 12/026* (2013.01); *B61B 7/02* (2013.01); *B61B 7/04* (2013.01); *B61B 7/045* (2013.01);
(Continued)

(58) Field of Classification Search
CPC ..... B61B 12/026; B61B 12/02; B61B 12/022; B61B 7/02; B61B 7/04; B61B 7/045; B61B 7/06; B61B 10/02; B61B 10/022
(Continued)

(56) References Cited

U.S. PATENT DOCUMENTS 6,332,406 B1 * 12/2001 Mugnier ..... E01B 25/12 104/96
8,635,958 B2 1/2014 Beck et al.
(Continued)

FOREIGN PATENT DOCUMENTS

DE 19704825 A1 11/1997
EP 0281205 A2 9/1988
(Continued)

OTHER PUBLICATIONS

Ulysse Lamalle. "Cours d'exploitation des Chemins de Fer—Pose de la voie en courbe" Jan. 1, 1949, Retrieved from the Internet: http://www.tassignon.be/trains/cecf/tomeIII_II/C_E_C_F_III_II.htm#p027 [retrieved on May 8, 2019] XP0555 86849 chapter III: parabolic connections.

*Primary Examiner* — S. Joseph Morano
*Assistant Examiner* — James William Jones
(74) *Attorney, Agent, or Firm* — Volpe Koenig

(57) ABSTRACT

An overhead structure, for a cableway installation of the type having at least one hauling cable, includes an entrance and an exit which are coupled respectively to an upstream portion and to a downstream portion, each generally rectilinear, of a pathway of the cableway installation. The structure also includes an intermediate portion that is curved, at least in projection in a horizontal plane of the pathway, between the entrance and the exit. The structure further includes active vehicle guidance, at least laterally, over a first portion of the curved intermediate portion, the first portion extending generally along a portion that is radioidal
(Continued)

or pseudo-radioidal at least in projection in the horizontal plane, or a mean plane which contains the entrance and the exit, and active guidance of the hauling cable between the entrance and the exit, capable of deflecting the cable at least laterally.

16 Claims, 14 Drawing Sheets

(51) Int. Cl.
*B61B 7/04* (2006.01)
*B61B 7/06* (2006.01)
*B61B 10/02* (2006.01)

(52) U.S. Cl.
CPC ..... *B61B 7/06* (2013.01); *B61B 10/02* (2013.01); *B61B 10/022* (2013.01); *B61B 12/02* (2013.01); *B61B 12/022* (2013.01)

(58) Field of Classification Search
USPC ..... 104/112
See application file for complete search history.

(56) References Cited

U.S. PATENT DOCUMENTS

2009/0038499 A1* 2/2009 Morris ..... B61B 7/06 105/148
2009/0151594 A1* 6/2009 Dur ..... B61B 12/026 104/112
2013/0112103 A1* 5/2013 Elhard ..... A63G 21/22 104/115
2015/0083016 A1* 3/2015 Fessler ..... B61B 7/02 104/112
2019/0092351 A1 3/2019 Richard et al.
2019/0168779 A1 6/2019 Mollet

FOREIGN PATENT DOCUMENTS

EP 1918171 A1 * 5/2008 ..... B61B 12/02
EP 2072367 A1 6/2009
EP 2591970 A1 * 5/2013 ..... B61B 7/06
EP 2853460 A1 4/2015
FR 2882321 A1 * 8/2006 ..... B61B 1/02
FR 3050425 A1 10/2017
FR 3052131 A1 12/2017
JP H06171501 A 6/1994
JP H09240466 A * 9/1997
JP 3021197 B2 * 3/2000
JP 2006224884 A * 8/2006
JP 2006224884 A1 8/2006
RU 2516858 C2 5/2014
WO WO-2009130239 A1 * 10/2009 ..... B61B 12/02
WO WO-2017093699 A1 * 6/2017 ..... B61B 13/04
WO WO-2017182736 A1 * 10/2017 ..... B61B 12/02
WO WO-2017184404 A1 * 10/2017 ..... A63G 21/22

* cited by examiner

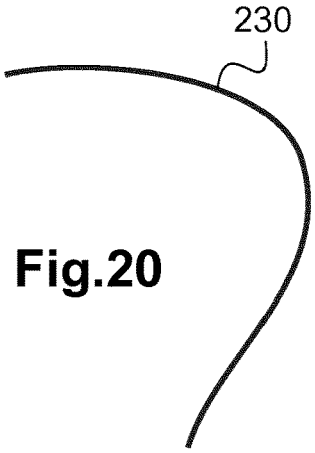
Fig.20
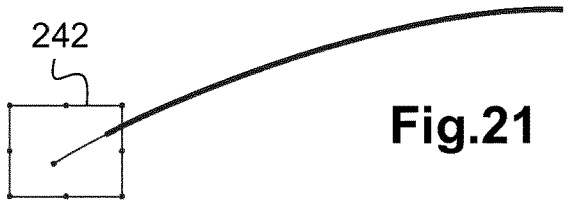
Fig.21
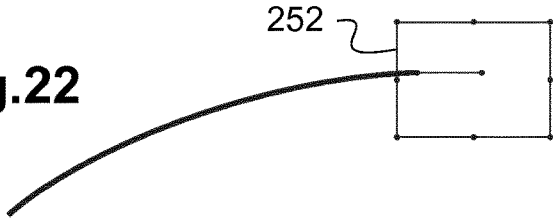
Fig.22
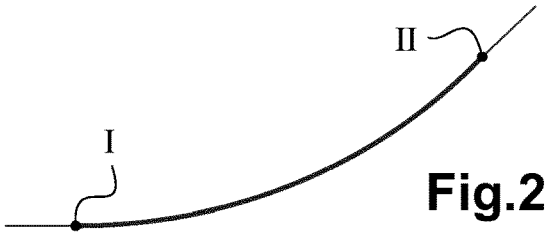
Fig.23
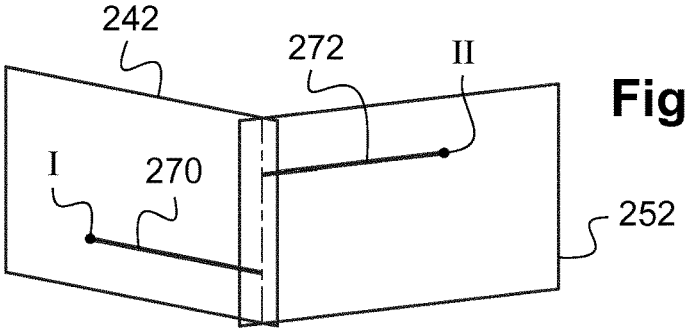
Fig.24
Fig.25
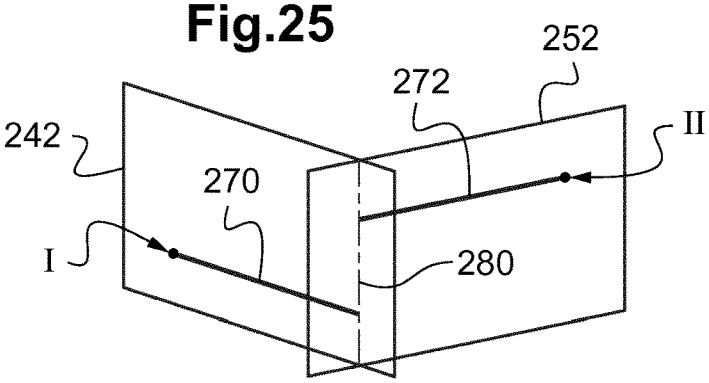

CORNERING STRUCTURE AND CABLEWAY INSTALLATION COMPRISING THIS STRUCTURE

FIELD OF THE INVENTION

The invention relates to an aerial structure of the type comprising an entry and an exit which are connected respectively to an upstream section and a downstream section of an aerial cable transport line which each extend in a generally rectilinear manner, at least projecting in a horizontal plane, these upstream and downstream sections being connected to one another by an intermediate section which is curved in this horizontal plane, the structure further comprising at least one lateral guidance system which acts on at least a first portion of the intermediate section.

BACKGROUND

Structures of this type are used in particular to interconnect an upstream line section and a downstream line section which each extend along a rectilinear gauge, projecting in a horizontal plane, when these respective gauges form an angle relative to one another in this horizontal plane, or a horizontal angle. In other words, such structures are used to guide an intermediate portion of the line according to a cornering gauge.

The French patent document FR2882321 describes a continuously moving high-speed embarking station for an aerial cable transport system with detachable seats, which includes a haulage lane for guiding and transporting the seats detached from the hauling cable, the haulage lane being subdivided into an arrival section, a departure parallel to the arrival section and an intermediate section curved through 180°, connecting the arrival section to the departure section. The intermediate section comprises a first contour and a second contour of different curvatures, the second contour associated with the departure section being constituted by a portion of a clothoid having a radius of curvature that is greater than that of the first contour associated with the arrival section. The haulage lane is located between two parallel transport pathways of the system. The arrival section is connected to one of these pathways, whereas the departure section is connected to the other. The seats travel along the haulage lane at a reduced speed, typically at a speed of about 0.5 meters per second, allowing skiers to board while walking. This boarding is intended to take place in the vicinity of the connection with a straight line of the departure section. This results in improved seat behavior before embarkation and high-capacity, flexible embarkation.

The German patent document DE 197 04 825 describes a single-cable type aerial cableway system in which an intermediate portion of the track/hauling cable is guided over columns distributed along a curved trajectory by means of rotating rollers. These rollers are designed to retract one after the other as vehicles pass. When retracted, a roller releases the track/hauling cable from its grip. The latter is then guided by the roller of the next column, which has not yet retracted, and by the roller of the previous column, which has already returned to its original position before being retracted.

In principle, the system described in the German patent document DE 197 04 825 is satisfactory. In practice, however, this system is limited to single-cable aerial cableways on the one hand, and to relatively small angles on the other hand. In the case of a large horizontal angle between the upstream line portion and the downstream line portion, the system in question becomes restrictive in that it requires a very long curved intermediate section.

The system in question is thus not suitable for use in urban or peri-urban environments, where space constraints are high and dual-cable aerial cableways are preferred. Moreover, in such an environment, aerial cableway systems must be efficient, which means that the vehicles can be moved quickly along the line without compromising passenger comfort.

The invention aims to improve this situation.

SUMMARY

The invention proposes an aerial structure for an aerial cableway system of the type comprising at least one hauling cable. The structure comprises an entry and an exit which are intended to be connected respectively to an upstream section and to a downstream section, each generally rectilinear, of a pathway of the aerial cableway system. The structure includes an intermediate section that is curved, at least projecting in a horizontal plane, connected to the entry and to the exit. The structure further comprises at least one active vehicle guidance system for guiding, at least laterally, on at least a first portion of the curved intermediate section. This first portion generally extends along a portion of a radioid, or pseudo-radioid, at least projecting in the horizontal plane, or a mean plane which contains said entry and said exit. The structure further comprises at least one hauling cable guidance system that is active between the entry and the exit and capable of deflecting this cable, at least laterally, between this entry and this exit.

The arrangement of one or more portions in the shape of a radioid, in particular a clothoid, through the corner allows the line path to be optimized. Assuming a constant vehicle travelling speed, a corner can be designed that is optimal in terms of space requirements, while ensuring that limit values for lateral acceleration or jerk, for example, are respected. Above all, ideal values relative to these limit values can be achieved, which makes it possible, in comparison with conventional systems, to either reduce the space requirement of the cornering structure for the same vehicle travelling speed or to increase this speed for the same space requirement.

The invention further proposes an aerial cable transport system comprising at least one structure as proposed hereinabove.

BRIEF DESCRIPTION OF THE DRAWINGS

The invention will be better understood after reading the following description, which is provided with reference to the drawings, in which:

FIGS. 20 to 28 are geometric representations illustrating the construction of a mean plane.

The drawings contain elements of a definite nature. They can thus be used not only to describe the invention, but also to contribute to the definition thereof, where appropriate.

DETAILED DESCRIPTION OF THE PREFERRED EMBODIMENTS

Figure 1:
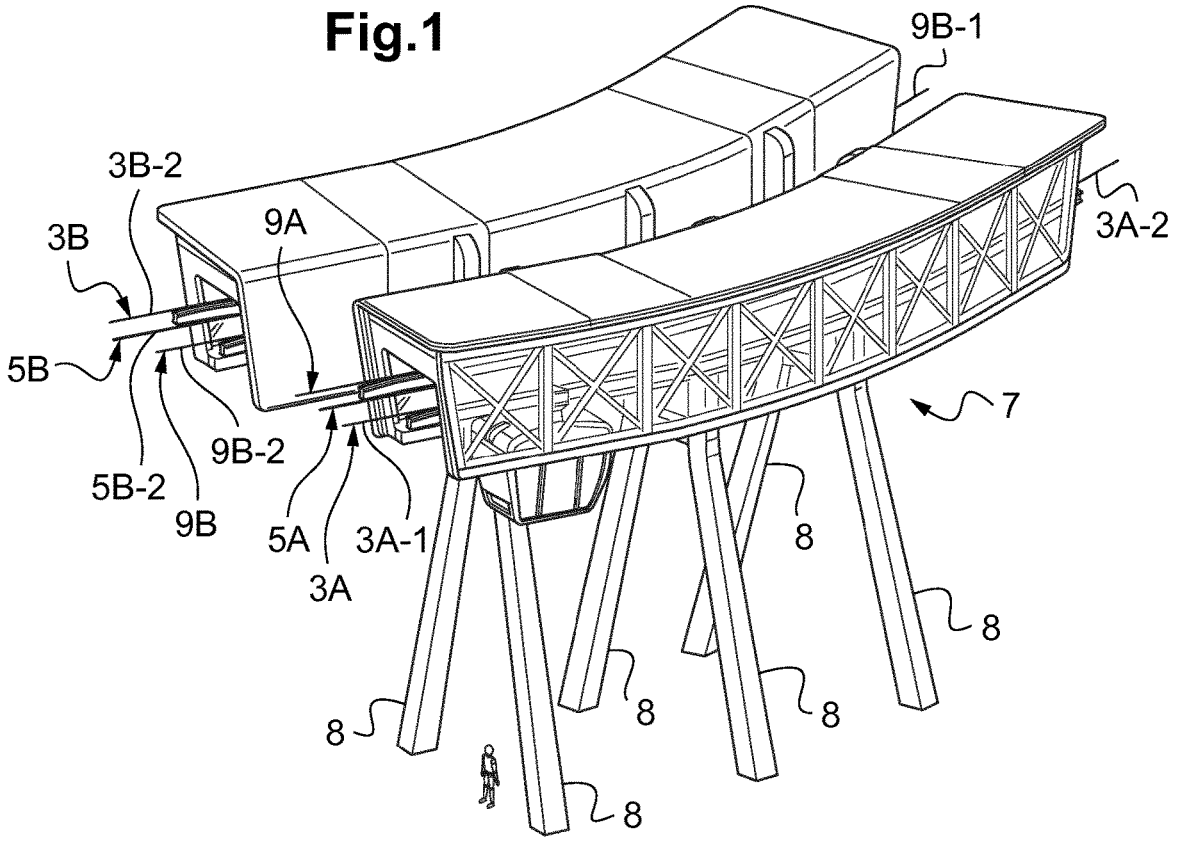
FIG. 1 is a perspective view of a cornering structure according to the invention.
Figure 2:
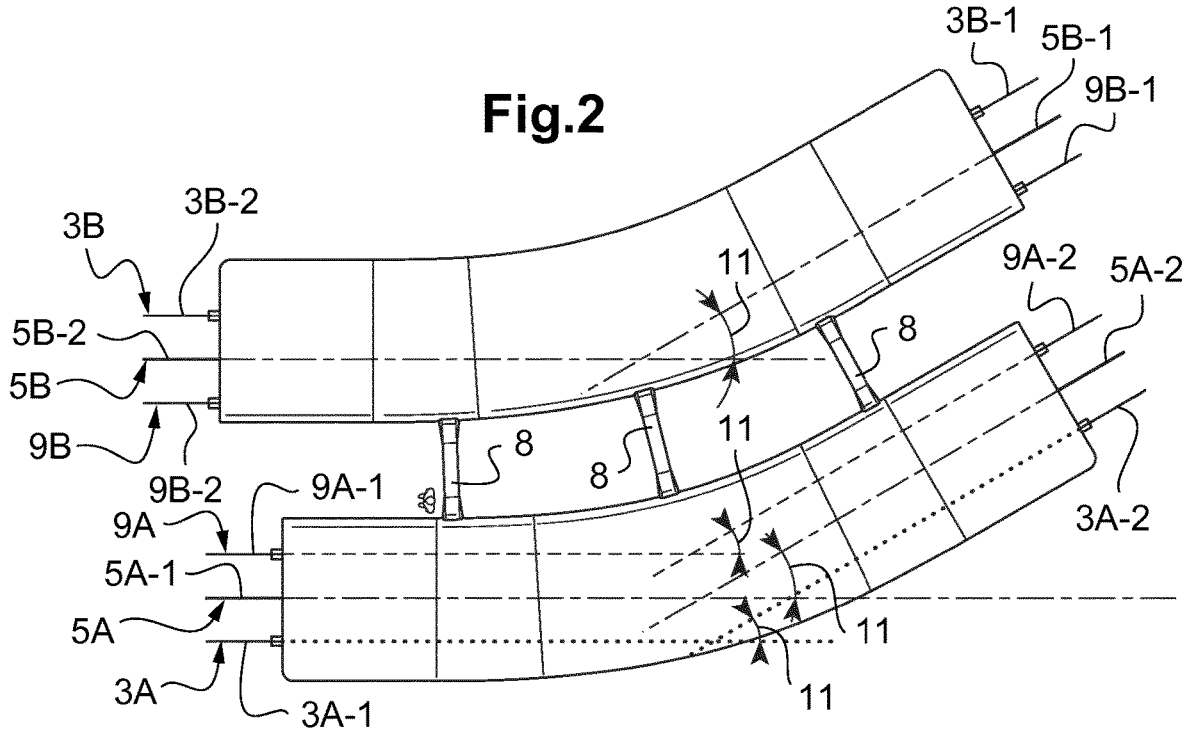
FIG. 2 shows the structure in FIG. 1 from above.

Reference is now made to FIGS. 1 and 2.

A cable car transport system, in this case of the aerial cableway system type, comprises a transport line with a first running pathway, or outgoing pathway, along which at least one track cable 3A and a first strand of a hauling cable, or outgoing strand 5A, extend. The system comprises an aerial structure 7 which helps to keep at least a portion of the track cable 3A and of the outgoing strand 5A in the air, following a line gauge. This aerial structure is, in this case, supported by a plurality of columns 8. In this case, the system further comprises an additional track cable, or second track cable 9A, which extends along the outgoing pathway and is also held in the air, at least in part, by the structure 7.

In this case, the transport line of the aerial cableway system further comprises a second running pathway, or return pathway, similar to the outgoing pathway. The counterpart cables to the cables of the outgoing pathway extend along this return pathway, i.e. a first track cable 3B, a second strand of the hauling cable, or return strand 5B, and a second track cable 9B. The first track cable 3B, the return strand 5B and the second track cable 9B of the return pathway are held in the air, according to the line gauge, at least partially by the structure 7.

The structure 7 also ensures a directional deflection, at least laterally, of the cables of the outgoing pathway between an upstream portion and a downstream portion which extend in a generally rectilinear manner, at least in the vicinity of the structure 7, projecting in at least a horizontal plane. The line gauge thus comprises a corner portion that connects two portions of this gauge which extend in a generally rectilinear manner, at least projecting in a horizontal plane. Moreover, the structure 7 guides the cables of the outgoing pathway along the corner portion of the line gauge.

In a similar manner, the structure 7 also ensures a directional deflection of the cables of the return pathway between an upstream portion which extends in a generally parallel manner to the downstream portion of the outgoing pathway and a downstream portion which extends in a generally parallel manner to the upstream portion of the outgoing pathway. The structure 7 further guides the cables of the return pathway in a corner portion of the line gauge, this corner portion being the counterpart of the corner portion of the outgoing pathway.

In the embodiment described here, the structure 7 deflects the cables from the outgoing pathway and the return pathway in a generally horizontal plane. The structure 7 provides a horizontal deflection of the line, without vertical deflection.

The track cable 3A comprises an upstream portion 3A-1 that extends along a first portion of the line gauge and a downstream portion 3A-2 that extends along a second portion of the line gauge. The first portion of the line gauge and the second portion thereof extend in a generally rectilinear manner, at least in the vicinity of the structure 7 and projecting on a horizontal plane. The first portion of the line gauge and the second portion thereof extend in a substantially horizontal plane and are inclined therein relative to one another by an angle Alpha 11. In this horizontal plane, the downstream portion 3A-2 of the first track cable 3A is inclined by an angle Alpha 11 relative to the upstream portion 3A-1 of this cable. In the example shown here, the angle Alpha 11 is approximately 30 degrees.

At least upstream and downstream of the structure 7, the outgoing strand 5A of the hauling cable extends generally parallel to the first track cable 3A and to the second track cable 9A. The outgoing strand 5A comprises an upstream portion 5A-1 and a downstream portion 5A-2 which is inclined horizontally by the angle Alpha 11 relative to the upstream portion 5A-1 thereof, whereas the second track cable 9A comprises an upstream portion 9A-1 and a downstream portion 9A-2 which is inclined horizontally by the angle Alpha 11 relative to the upstream portion 9A-1 thereof.

Similarly, the structure 7 ensures the deflection of an upstream portion of the return pathway towards a downstream portion of this pathway, in particular an upstream portion 5B-1 of the return strand 5B towards a downstream portion 5B-2, an upstream portion 3B-1 towards a downstream portion 3B-2 of the third track cable 3B and an upstream portion 9B-1 towards a downstream portion 9B-2 of the fourth track cable 9B.

Figure 3:
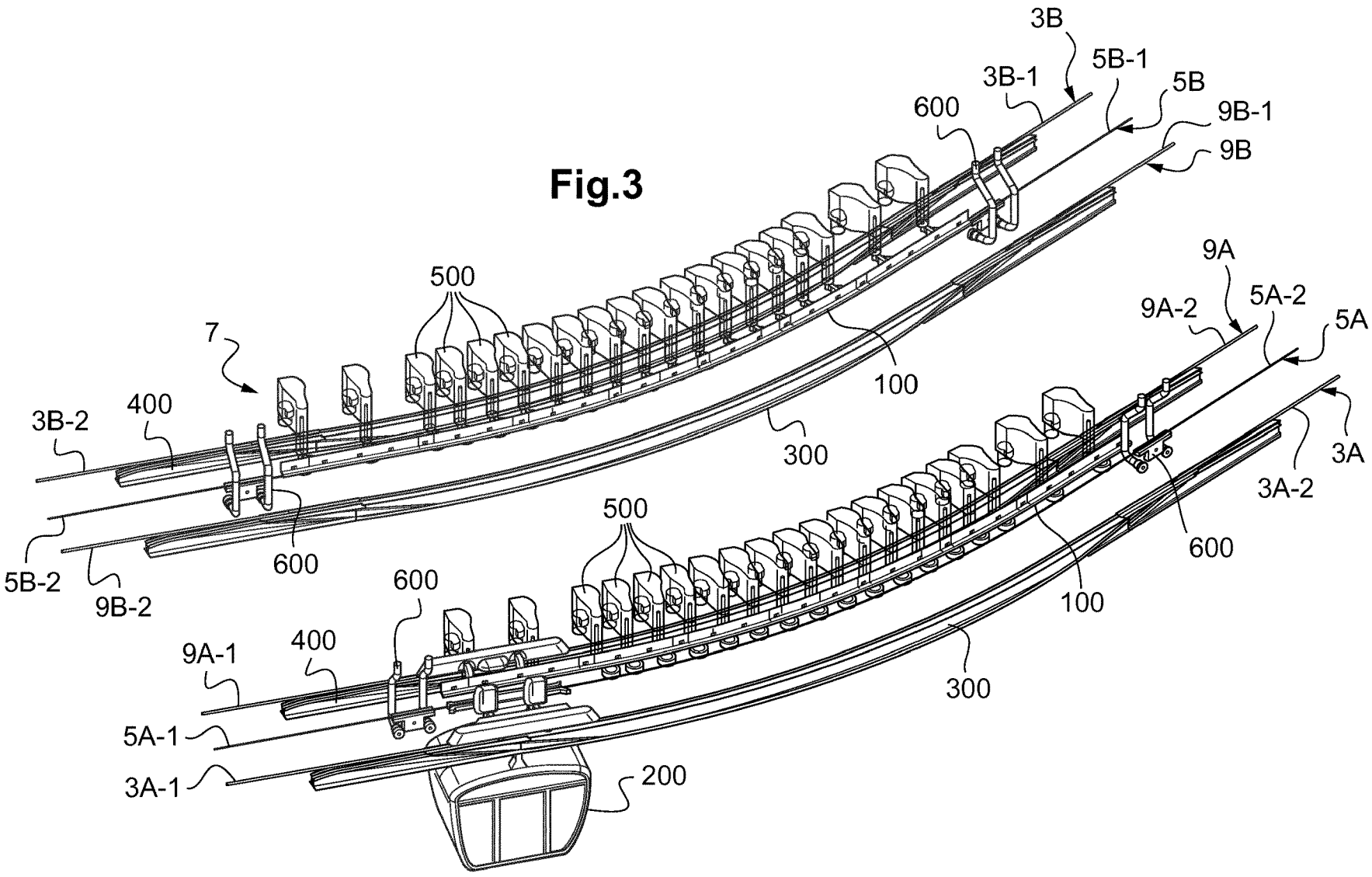
FIG. 3 shows a partial view of the cornering structure in FIG. 1.
Figure 4:
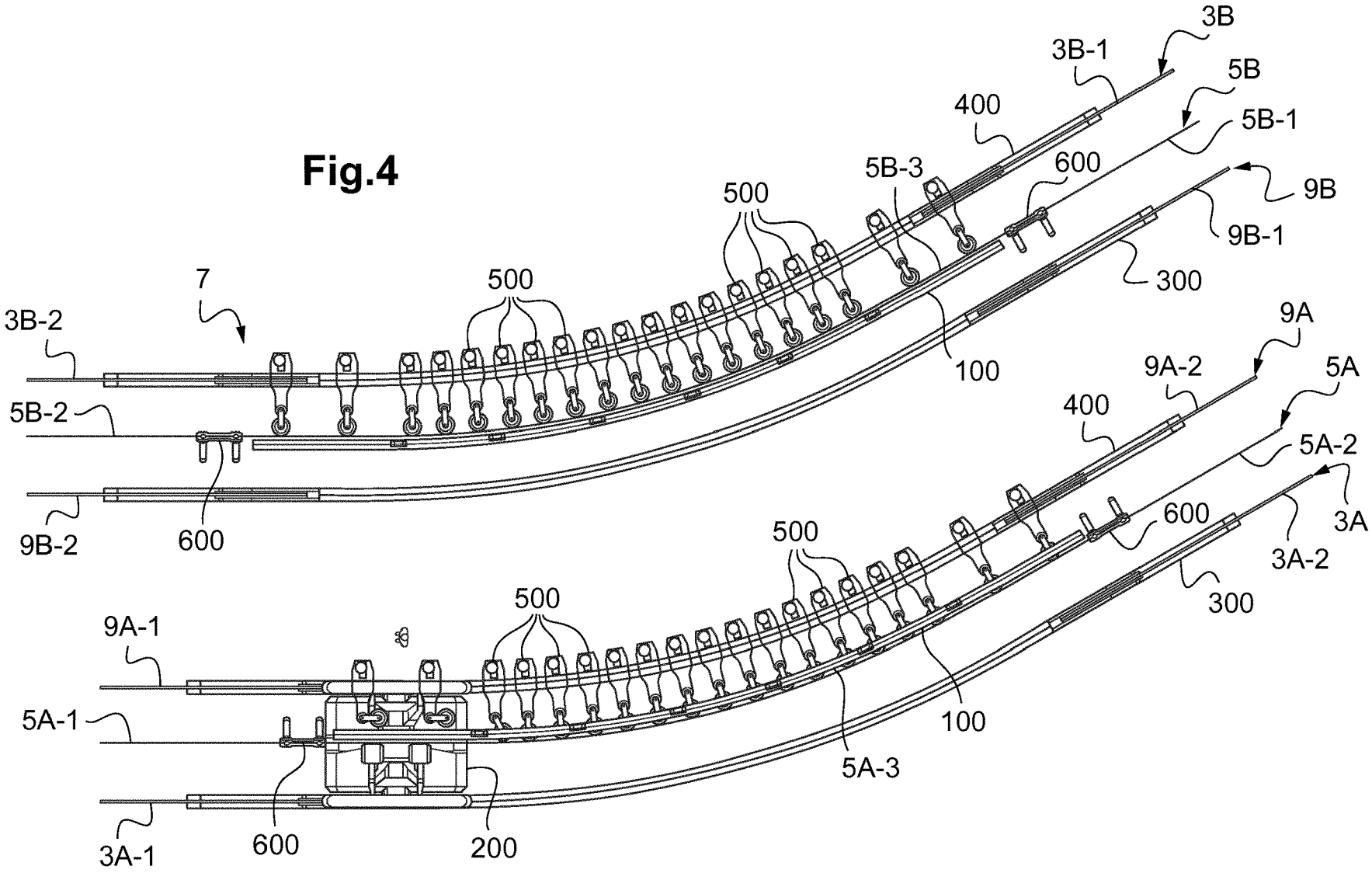
FIG. 4 is an overhead view corresponding to that shown in FIG. 3.

Reference is now made to FIGS. 3 and 4.

A cornering structure, for example the structure 7 in FIGS. 1 and 2, comprises a vehicle guidance system inserted between an upstream portion of a running pathway, for example the outgoing pathway, which is generally rectilinear, and a downstream portion thereof, which is generally rectilinear and inclined horizontally relative to the upstream portion, for example by the angle Alpha 11 shown in FIGS. 1 and 2.

The vehicle guidance system comprises a curved rail 100 that extends along the corner portion of the line gauge. On entering a corner, each vehicle 200 travelling on the outgoing pathway engages on the curved rail 100 at a first end thereof. On exiting the corner, the vehicle 200 disengages from the curved rail 100 at a second end thereof, opposite the first. The curved rail 100 guides the vehicle laterally.

The cornering structure further comprises a track for the vehicle 200, which connects the upstream portion of the running pathway to the downstream portion. The track comprises a first curved beam, or outer beam 300, which connects an upstream portion of a track cable, for example the upstream portion 3A-1 of the first track cable 3A in FIGS. 1 and 2, to the downstream portion thereof, for example the downstream portion 3A-2. The track in this case further comprises a second curved beam, or inner beam 400, which is the counterpart of the outer beam 300 for an additional track cable of the running pathway, for example the second track cable 9A of the outgoing pathway in FIGS. 1 and 2.

On entering a corner, at least in the vicinity thereof, the vehicle 200 disengages from the one or more track cables, for example the first track cable 3A and the second track cable 9A of the outgoing pathway, in order to travel on the track, in this case on an upper face of the outer beam 300 and an upper face of the inner beam 400. As it travels along this track, the vehicle 200 is guided laterally along a curved trajectory by means of the curved rail 100. The track, and in particular the outer beam 300 and the inner beam 400, does not contribute, at least in this example embodiment, to the lateral guidance of the vehicle 200 through the corner.

The outer beam 300 and the inner beam 400 furthermore hold their respective track cable inside the line gauge, not only on the upstream and downstream portions thereof, but also on the curved intermediate portion. The outer beam 300 and the inner beam 400 contribute to holding their respective cable in the air. These beams 300 and 400 furthermore guide their respective cable laterally, along the trajectory of the corner.

The cornering structure further comprises a deflection mechanism for deflecting the hauling cable, for example the outgoing strand 5A in FIGS. 1 and 2, between an upstream portion 5A-1, and a downstream portion 5A-2, which are inclined relative to one another in a horizontal plane. This deflection mechanism comprises a set of guide elements 500 distributed along the trajectory of the corner and which act on an intermediate portion 5A-3 of the outgoing strand 5A of the hauling cable. These elements 500 contribute to holding and guiding the outgoing strand 5A in the line gauge thereof, at least on the intermediate portion 5A-3 thereof.

In this case, the deflection mechanism acts in a horizontal plane only. A support 600 is provided in each case at the entry and exit of the corner, typically comprising one or more rotatably mounted rollers, which helps to hold the hauling cable in the air, in this case supporting it, on a support structure of the type of the structure 7 in FIGS. 1 and 2.

The inner beam 400, the outer beam 300, the curved rail 100 and the intermediate portion 5A-3 of the outgoing strand 5A of the hauling cable extend in a generally parallel manner to one another in the corner.

Figure 5:
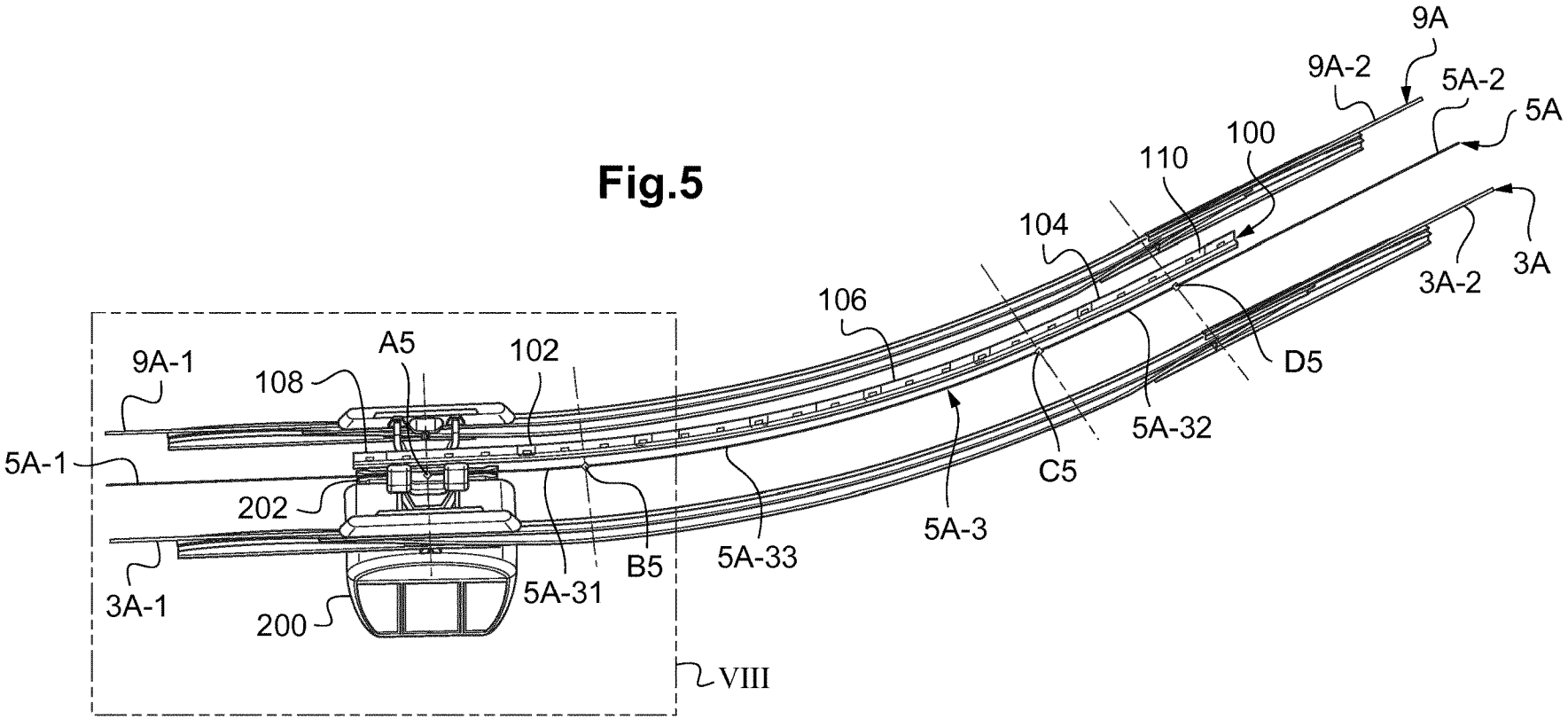
FIGS. 5 and 6 show a portion of that shown in FIG. 3.

Reference is now made to FIG. 5.

At the entry to the corner (reference A5), a portion of the outgoing strand 5A of the hauling cable adjacent to the generally rectilinear upstream portion 5A-1 of this strand, or entry portion 5A-31, is guided along a profile that follows a portion of a clothoid. The entry portion 5A-31 ends at the reference B5 provided in FIG. 5.

At the exit of the corner (reference D5), a portion of the outgoing strand 5A of the hauling cable adjacent to the generally rectilinear downstream portion 5A-2 of this strand, or exit portion 5A-32, is guided along a profile that follows a portion of a clothoid. The exit portion 5A-32 begins at the reference C5 shown in FIG. 5. In this case, the exit portion 5A-32 is symmetrical to the entry portion 5A-31.

Between the entry portion 5A-31 and the exit portion 5A-32, a connecting portion 5A-33 of the outgoing strand 5A of the hauling cable (from reference B5 to reference C5) is guided along a profile that follows an arc of a circle. The radius RO of this circle corresponds to the radius of the clothoid-shaped profile at an adjacent end of the entry portion 5A-31. This radius RO further corresponds to the radius of the clothoid-shaped profile at an adjacent end of the exit portion 5A-32. Each portion that follows a clothoid-shaped profile provides a continuous transition between an infinite radius of curvature, corresponding to a rectilinear upstream or downstream portion, and the radius of curvature RO of the connecting portion 5A-33.

At the entry portion 5A-31, the exit portion 5A-32 and the connecting portion 5A-33, the outgoing strand 5A of the hauling cable is guided, for example, by elements of the type of the guide elements 500 shown in FIGS. 3 and 4, which are distributed along the profile in question.

In this case, the vehicle 200 is engaged on the outgoing strand 5A of the hauling cable via an attachment 202 which is located substantially in line with the center of inertia of the vehicle 200. This center of inertia thus follows a trajectory that is the counterpart of the profile of the hauling cable 5, in particular in the corner.

The curved rail 100 provides lateral guidance for the vehicle 200. The curved rail 100 is offset orthogonally relative to the profile of the outgoing strand 5A of the hauling cable. The curved rail 100 guides the vehicle 200 through the corner along a trajectory such that the center of inertia of the vehicle 200 follows the profile of the outgoing strand 5A of the hauling cable along the curved portion 5A-3 thereof.

In the vicinity of one of the ends thereof, the curved rail 100 comprises a first section, or entry section 102, which is the counterpart of the entry portion 5A-31 of the hauling cable 5. The entry section 102 is generally shaped as a portion of a pseudo-clothoid, i.e. as a curve resulting from an orthogonal offset of a portion of a clothoid. In this case, the portion of a clothoid in question corresponds to the clothoid-shaped profile of the entry portion 5A-31 of the outgoing strand 5A of the hauling cable. This orthogonal offset substantially corresponds to the orthogonal offset between the outgoing strand 5A of the hauling cable and the curved rail 100.

In the vicinity of the other of the ends thereof, the curved rail 100 comprises a second section, or exit section 104, which is the counterpart of the exit portion 5A-32 of the outgoing strand 5A of the hauling cable. The exit section 104 is generally shaped as a portion of a pseudo-clothoid, resulting from the orthogonal offset of the exit section 5A-32 of the outgoing strand 5A of the hauling cable. The entry section 102 and the exit section 104 are symmetrical to one another.

Between the entry section 102 and the exit section 104, the curved rail 100 comprises an intermediate section 106, one end whereof connects to the entry section 102 and an opposite end to the exit section 104. The intermediate section 106 is the counterpart of the connecting portion 5A-33 of the outgoing strand 5A of the hauling cable. The intermediate section 106 is shaped as an arc of a circle resulting from the orthogonal offset of the connecting section 5A-33 of the outgoing strand 5A of the hauling cable.

In this case, the curved rail 100 extends on its entry section 102 side (upstream of the reference A5) and on its exit section 104 side (downstream of the reference D5) into a first straight section 108 and a second straight section 110 respectively.

The rail has a profile-like appearance. This can be produced at least in part by bending with a variable radius or by forging, such that the profile is bent according to the sections described. It can also be produced by assembling profiled elements joined such that they follow the portions in question as closely as possible. Where appropriate, at least some of these elements can be bent. The bend radius can be determined to best follow these portions. At least some of these elements can themselves be welded built-up profiles.

Figure 6:
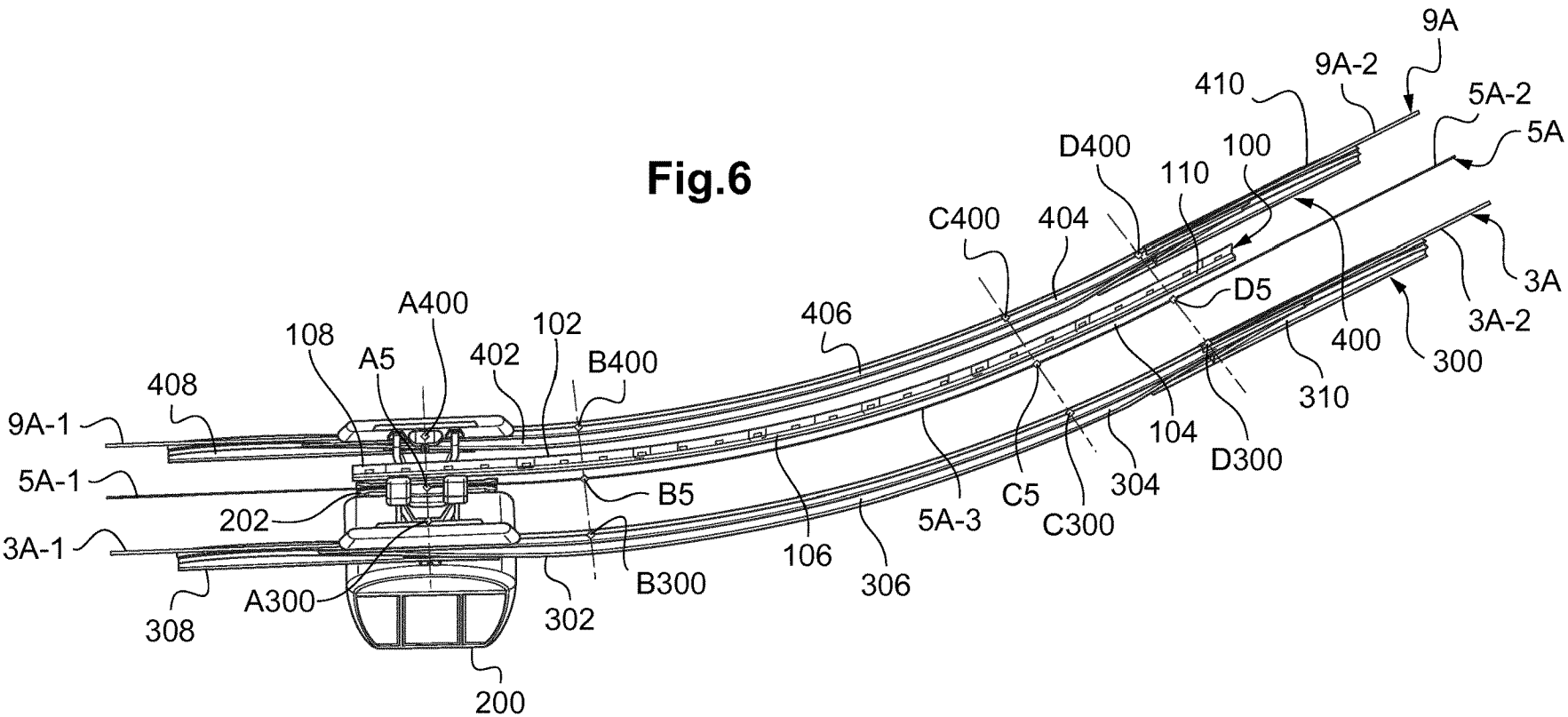
Figure 7:
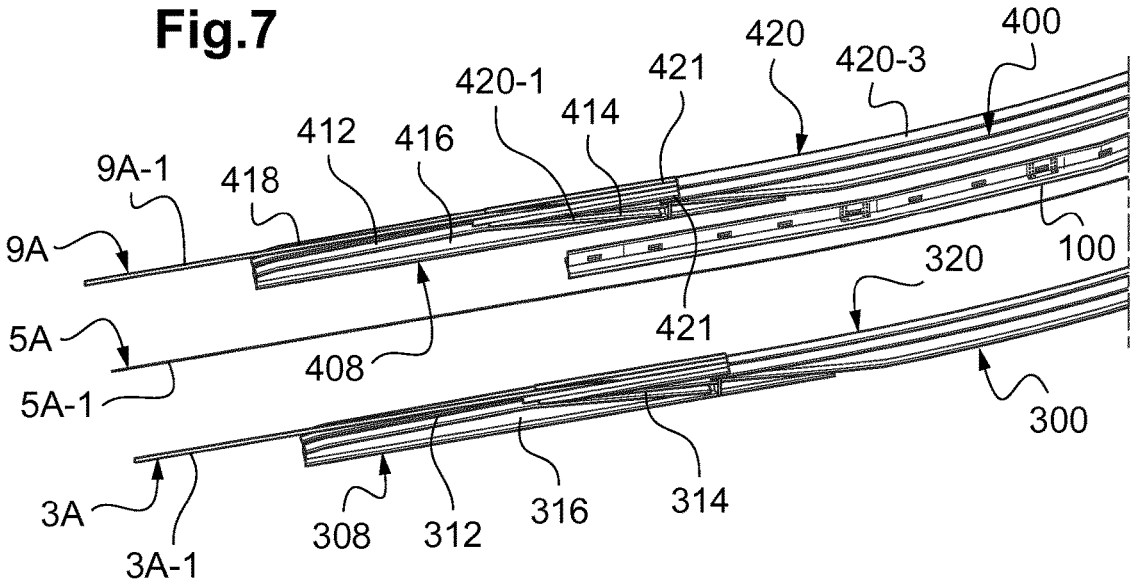
FIG. 7 shows a feature VII from FIG. 5, without any vehicle.
Figure 8:
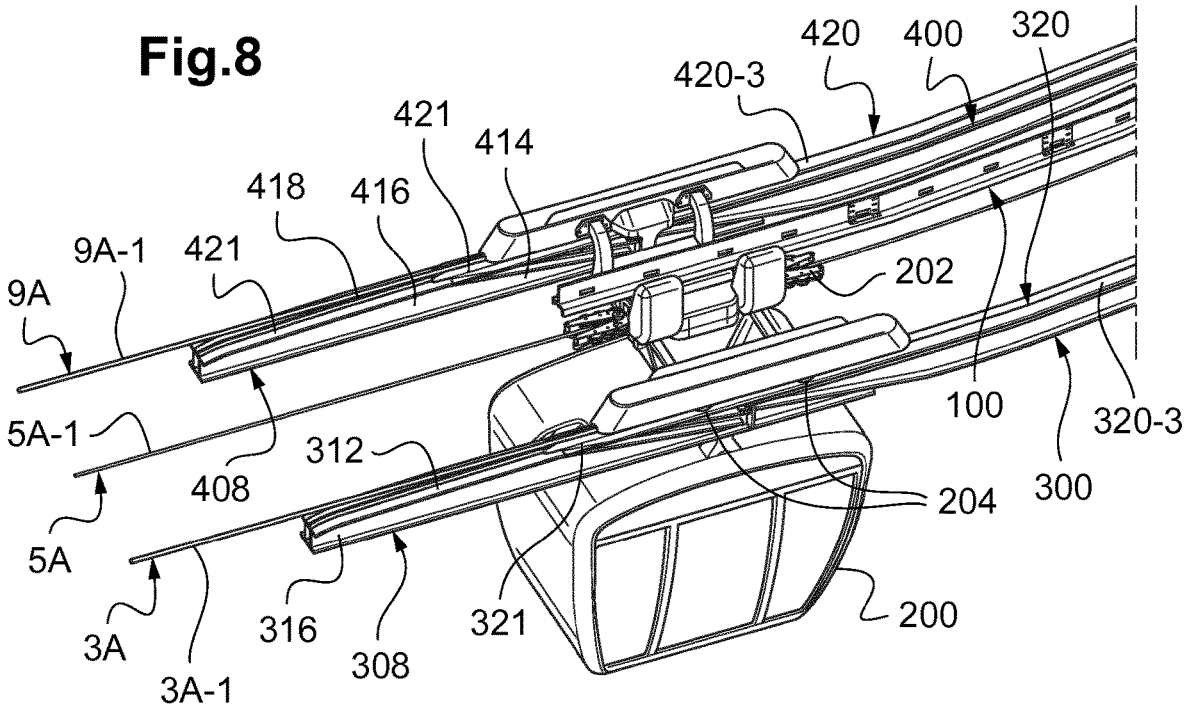
FIG. 8 shows the feature VII from FIG. 5 with a vehicle.

Reference is now made to FIG. 6.

The outer beam 300 and the inner beam 400 each comprise an entry section 302 or 402 (from the reference A300 to the reference B300 for one, from the reference A400 to the reference B400 for the other), which is the counterpart of the entry section 5A-31 of the outgoing strand 5A of the hauling cable. Each entry section 302, 402 extends generally along a portion of a pseudo-clothoid, i.e. along a curve resulting from an orthogonal offset of a portion of a clothoid. In this case, the portion of a clothoid in question corresponds to the clothoid of the entry section 5A-31 of the outgoing strand 5A of the hauling cable. This orthogonal offset corresponds substantially to the orthogonal offset between the outgoing strand 5A of the hauling cable and the first track cable 3A of the outgoing pathway on the one hand, and, on the other hand, the outgoing strand 5A of the hauling cable and the second track cable 9A of the outgoing pathway, upstream and downstream of the corner.

Similarly, the outer beam 300 and the inner beam 400 each comprise an exit section 304 or 404 (from the reference C300 to the reference D300 for one, from the reference C400 to the reference D400 for the other), which is the counterpart of the exit section 5A-32 of the outgoing strand 5A of the hauling cable. Each exit section 304, 404 extends generally along a portion of a pseudo-clothoid resulting from the orthogonal offset of the exit section 5A-32 of the outgoing strand 5A of the hauling cable.

In this case, the outer beam 300 and the inner beam 400 each further comprise an intermediate section 306 or 406 (from the reference B300 to the reference C300 for one, from the reference B400 to the reference C400 for the other) which connects, at one end, to the entry section 302 or 402 of the beam, and, at an opposite end, to the exit section 304 or 404 thereof. Each intermediate section 306 or 406 extends according to an arc of a circle resulting from the orthogonal offset of the connecting section 5A-33 of the outgoing strand 5A of the hauling cable.

In this case, the outer beam 300 and the inner beam 400 each extend on their entry section 302 or 402 side (upstream of the reference A300 for one, and of the reference A400 for the other) and on their exit section 304 or 404 side (downstream of the reference D300 for one and of the reference D400 for the other) into a first straight section 308 or 408 and a second straight section 310 or 410 respectively.

The outer beam 300 and the inner beam 400 can be manufactured in the same way as the curved rail 100, in particular by bending, forging or assembling bent elements.

Reference is now made to FIGS. 7 to 10.

The first straight section 308 of the outer beam 300 and the first straight section 408 of the inner beam 400 each have an upper face on which two longitudinal segments are distinguished.

On a first segment 412, close to the upstream portion of the transport pathway, the upper face of the inner beam 400 is arranged like a cable support, in this case the upstream portion 9A-1 of the second track cable 9A of the outgoing pathway. The first segment 412 is arranged like a portion of what is known in the art as a cable carrier. The upper face of the first segment 412 is shaped like a half arch, which rises towards the downstream portion of the pathway.

On a second segment 414, adjacent to the first segment 412 and remote from the upstream portion of the pathway, the inner beam 400 is arranged such that it progressively deflects the second track cable 9A downwards on the upper face of this second segment 414. This upper face of the second segment is furthermore arranged as a running surface for the vehicle 200.

The first straight section 408 of the inner beam 400 is made in this case from an elongate beam element 416. The portion of this element corresponding to the second segment 414 has an upper face shaped as an inclined plane which decreases from the upper face corresponding to the first segment 412.

On the portions corresponding to the first segment 412 and to the second segment 414, the beam element 416 bears, at the upper face, a cable insert 418 which receives the second track cable 9A. This second track cable 9A substantially follows the upper face of the beam element 416.

In a middle region of the inclined plane, this beam element 416 connects to one end of the rest of the inner beam 400, providing a passage for the second track cable 9A. For this purpose, the end of the rest of the inner beam 400 is beveled in this case. The second track cable 9A follows the beam element 416, which brings it to the lower face of the inner beam 400. There, guide elements 419, in the form of cable insert segments, hold the intermediate portion 9A-3 of the second track cable 9A in the corner portion of the line gauge thereof.

The upper face of the inner beam 400 comprises a running flat 420, which in this case at least partially covers the upper face of one or more profile elements assembled to at least partially form the inner beam 400. At one of the ends thereof, this flat 420 stops in the vicinity of the apex of the first segment 412. The upper face of the flat 420 extends along a very slightly inclined and rising plane in the direction of the downstream end of the second segment 414. In the vicinity of this end, the upper face of the running flat reaches its apex, i.e. its constant elevation around the corner. From this apex to the end of the rest of the inner beam, the flat 420 extends to the same height. In the example embodiment shown here, the flat 420 is made in a plurality of sections, i.e. a first section 420-1 which substantially corresponds to the first beam element 416, a second section 420-2 which substantially corresponds to a second beam element that is the counterpart of the first beam element 416 for the second straight section 410 and a third section 420-3 which extends over the greater part of the inner beam 400 and connects to the first section 420-1 of the flat 420 and to the second section 420-2 thereof.

Along the first section 420-1 of the flat 420, two transition angles 421, arranged symmetrically on either side of the cable insert 418, have a narrow, substantially horizontal running surface at the respective apexes thereof.

The outer beam 300 is arranged in a similar way to the inner beam 400. The elements of the outer beam are denoted by the reference of their counterpart in the inner beam 400 minus one hundred.

On entering the cornering structure 7, the vehicle 200 firstly travels on the upstream portions 3A-1 and 9A-2 of the first track cable 3A and of the second track cable 9A of the outgoing pathway via main rollers (not shown in these figures). These upstream portions are supported by the first straight sections 308 and 408 of the outer beam 300 and the inner beam 400, respectively, until, in the vicinity of the upstream end of the second segments 314 and 414, the rim of these main rollers is flush with the running surfaces of the transition angles 321 and 421. As the vehicle 200 travels along the second segments 314 and 414, the main rollers disengage from the first track cable 3A and from the second track cable 9A of the outgoing pathway, as these are gradually deflected downwards. The vehicle 200 then travels over the transition angles 321 and 421, until, in the vicinity of the downstream end of the second segments 314 and 414, auxiliary rollers of the vehicle 200 (not shown in these figures) are flush with the slightly inclined plane of the first sections 320-1 and 420-1 of the running flats 320 and 420. From there, and throughout the entire length of the intermediate sections 306 and 406 of the outer beam 300 and the inner beam 400, the vehicle 200 travels on the running flats 320 and 420 via these auxiliary rollers. The second segment 314 of the first rectilinear segment 308 of the outer beam 300, and its counterpart 414 of the inner beam 400, form a transition area between a vehicle 200 travelling on the track cables and travelling on the track formed by the rest of the outer beam 300 and the inner beam 400. Unlike travelling on the track cables, where the groove of the main rollers guides the vehicle 200 along these cables, travel on the track of the outer beam 300 and the inner beam 400 is laterally free. The lateral guidance of the vehicle 200 is provided by the curved rail 100. It is important that the vehicle 200 engages the curved rail 100 substantially as it disengages from the track cables. The curved rail 100 thus starts in the vicinity of where the one or more track cables are deflected downwards on the first rectilinear sections 308 and 408.

The second rectilinear sections 310 and 410 of the outer beam 300 and the inner beam 400 are arranged in a similar and symmetrical manner to the first rectilinear sections 308 and 408 of these beams. Thus, at the end of the corner, the vehicle 200 re-engages the track cables.

Figure 11:
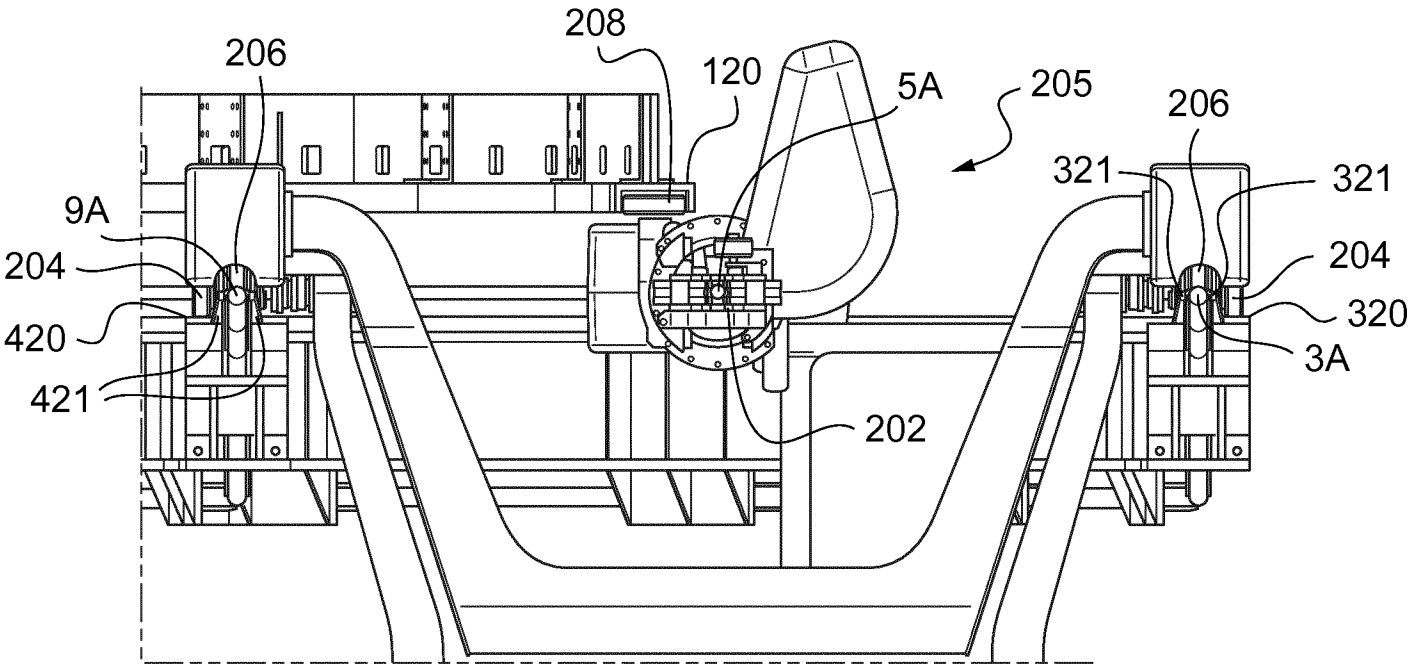
FIG. 11 shows a vehicle carriage engaged on the cornering structure in FIG. 1 from the front.
Figure 9:
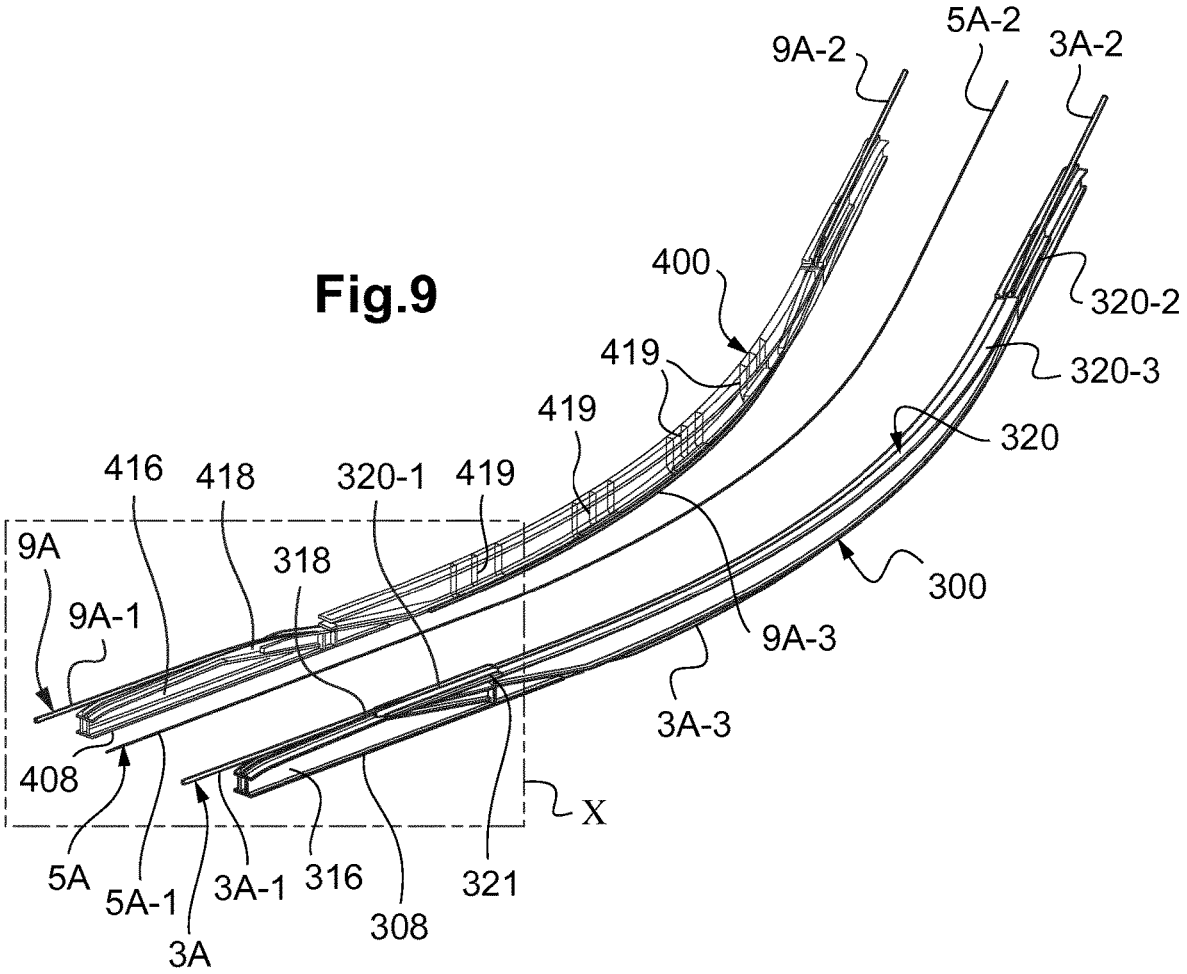
FIG. 9 shows a part of FIG. 3 without a guide rail.
Figure 10:
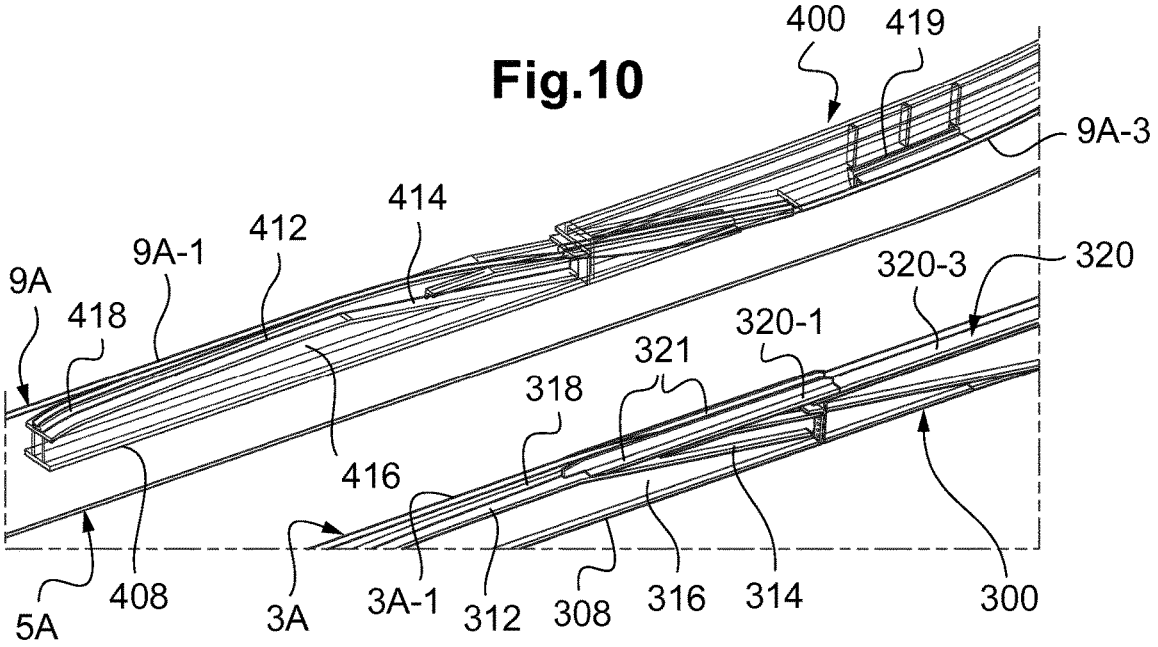
FIG. 10 shows a feature X from FIG. 9.

Reference is now made to FIG. 11.

It shows the upper part, or carriage 205, of the vehicle 200 via which the connection of this vehicle 200 with the track cables is made, in this case with the first track cable 3A and the second track cable 9A of the outgoing pathway, and the hauling cable, in this case the outgoing strand 5A thereof.

The carriage 205 comprises a pair of auxiliary rollers 204 each rolling in this case on a respective running flat 320 or 420 of the outer beam 300 and the inner beam 400. The carriage 205 further comprises a pair of main rollers 206 each engaged inside one of the first track cable 3A and the second track cable 9A of the outgoing pathway. The carriage 205 further comprises the grip 202 engaged with the outgoing strand 9A of the hauling cable.

In the vicinity of the grip 202, the carriage 205 includes a rotatably mounted guide roller 208. This guide roller 208 engages inside a longitudinal channel 120 of the curved rail 100. This channel 120 extends in the general direction of the curved rail 100, in this case in two sections in the shape of portions of a pseudo-clothoid connected to one another by a section in the shape of an arc of a circle. It is the engagement of the guide roller 208 inside the channel 120 that enables the vehicle 200 to be guided laterally through the corner.

Figure 12:
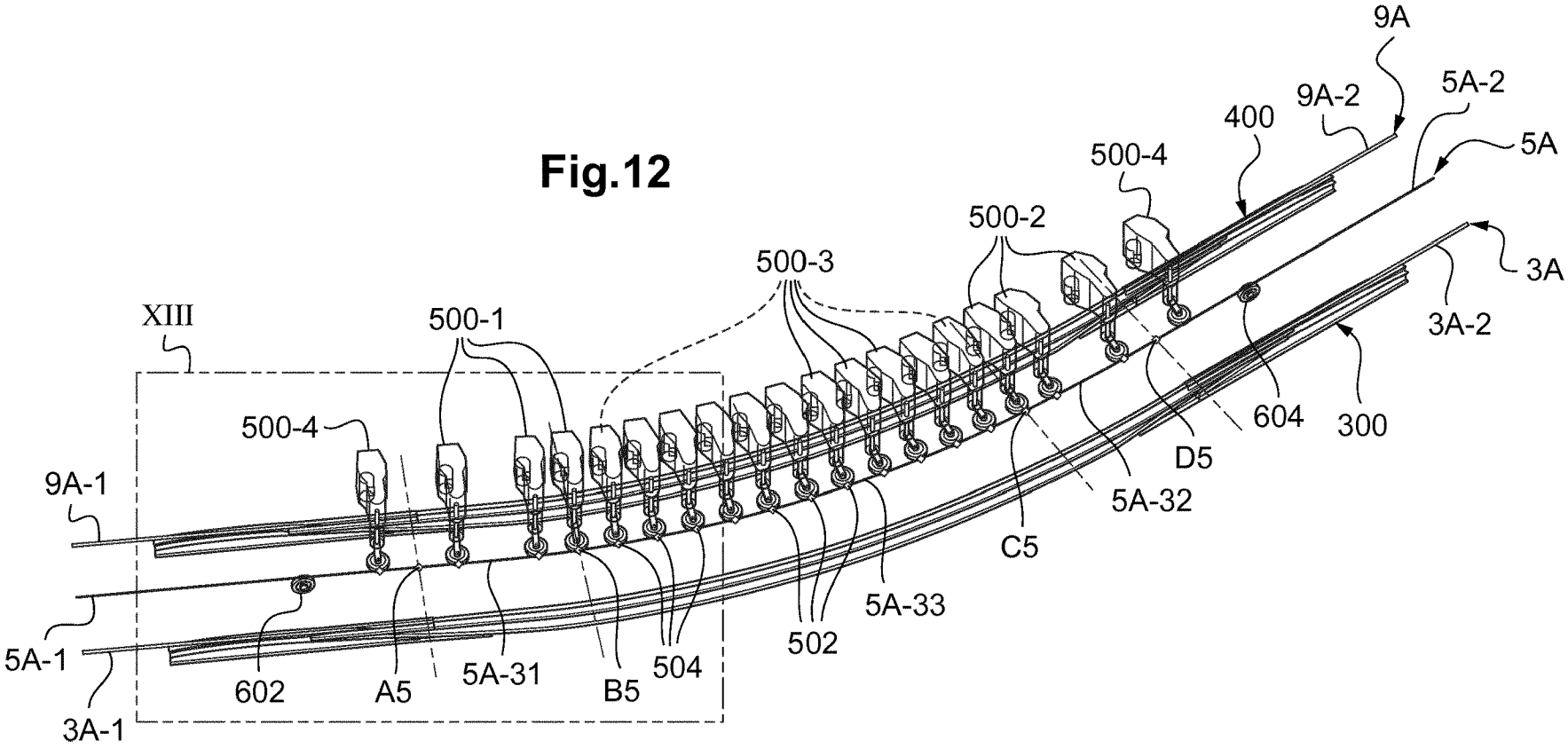
FIG. 12 shows a part of FIG. 3 without any vehicle or guide rail.

Reference is now made to FIG. 12.

Each guide element 500 guiding the hauling cable, in this case the outgoing strand 5A thereof, carries a respective rotating roller 502 inside which the hauling cable engages. The guide elements 500 are mounted on a support structure not shown, distributed through the corner. These elements 500 are positioned on the support structure in such a way that the respective point of contact 504 thereof with the outgoing strand 5A of the track cable is disposed along a determined profile. This profile corresponds to that described for the outgoing strand 5A of the hauling cable in relation to FIG. 7 in particular.

Thus, the invention provides a first sub-assembly 500-1 of elements 500 distributed so as to guide the outgoing strand 5A of the hauling cable over the entry portion 5A-31, a second sub-assembly 500-2 of elements 500 distributed so as to guide the outgoing strand 5A over the exit portion 5A-32, and a third sub-assembly 500-3 of elements 500 distributed so as to guide the outgoing strand 5A horizontally over the connecting portion 5A-33. Moreover, a pair of guide elements 500-4 disposed upstream and downstream of the corner is provided in this case. Vertical guidance is ensured, at least in part, by an upstream roller 602 and a downstream roller 604.

As a result of this distribution of the guide elements 500, the outgoing strand 5A of the hauling cable is guided through the corner along a profile that generally follows a portion of a clothoid at the entry and a portion of a clothoid at the exit, these portions being connected to one another by a portion in the shape of an arc of a circle. Between two adjacent guide elements 500, the outgoing strand 5A of the cable follows a rectilinear profile. The outgoing strand 5A of the hauling cable generally follows the trajectory of the center of inertia of the vehicle, in segments with ends disposed along this trajectory.

Figure 13:
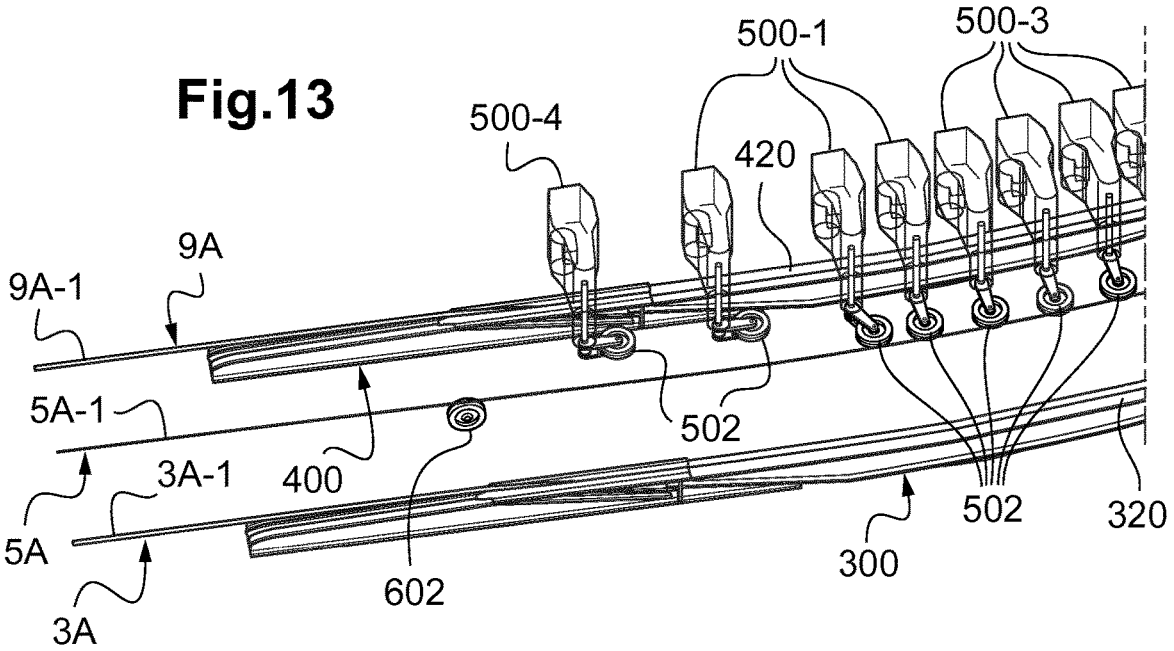
FIG. 13 shows a feature XIII from FIG. 12, without any vehicle and with retracted rollers.
Figure 14:
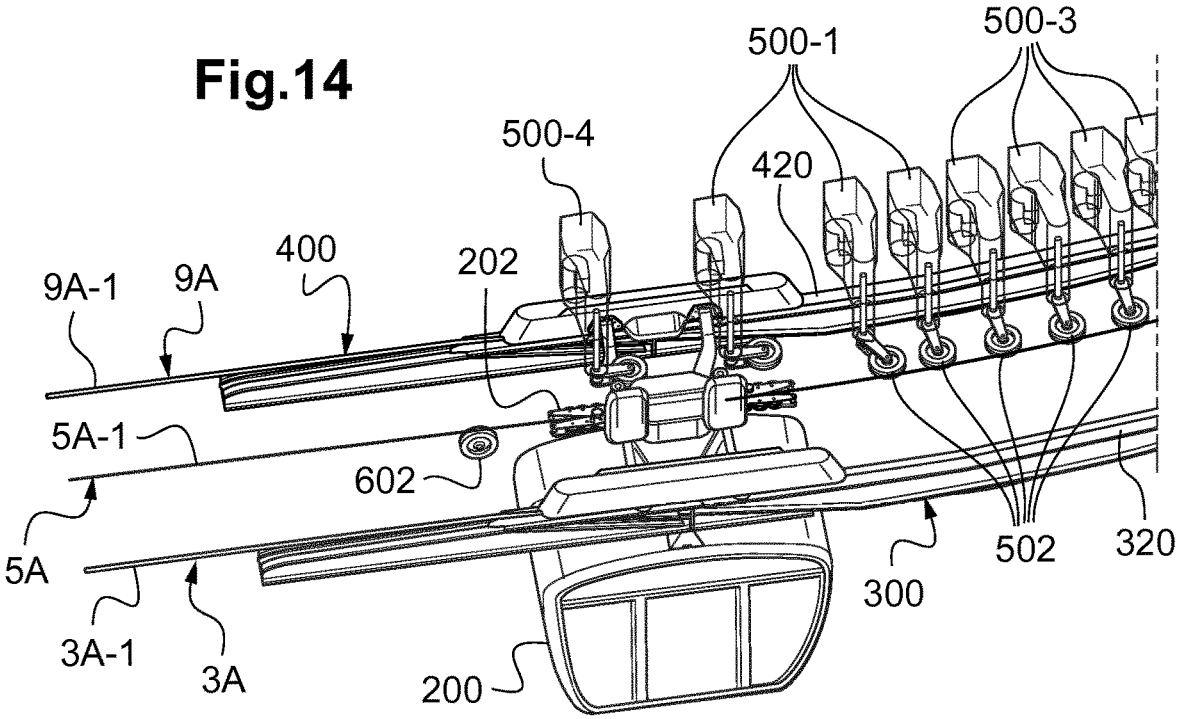
FIG. 14 is similar to FIG. 13, but with a vehicle.

Reference is now made to FIGS. 13 and 14.

As the vehicle 200 advances through the curve, the rollers 502 of the guide elements 500 retract one after the other to allow the carriage 205 of the vehicle 200 to pass. In the same way, these rollers 502 return to position one after the other after the carriage 205 has passed.

Each roller 502 is retracted by a respective mechanism internal to the corresponding guide element 500. In this case, this mechanism acts to retract the rollers 502 via an essentially rotational motion. Alternatively, this mechanism retracts the rollers 502 via a translational motion. Such a mechanism is, for example, described in the French patent document FR 3 050 425, cited solely for illustration purposes and not intended to limit the scope of the invention.

The description of FIGS. 3 to 14 given hereinabove in relation to the outgoing pathway of an aerial cable transport line applies in a similar manner to the return pathway of this line. Wherever possible, elements of the return pathway in these figures have been designated with the references of their counterpart element of the outgoing pathway, by replacing, where appropriate, the letter "A" with the letter "B" in these references.

Figure 15:
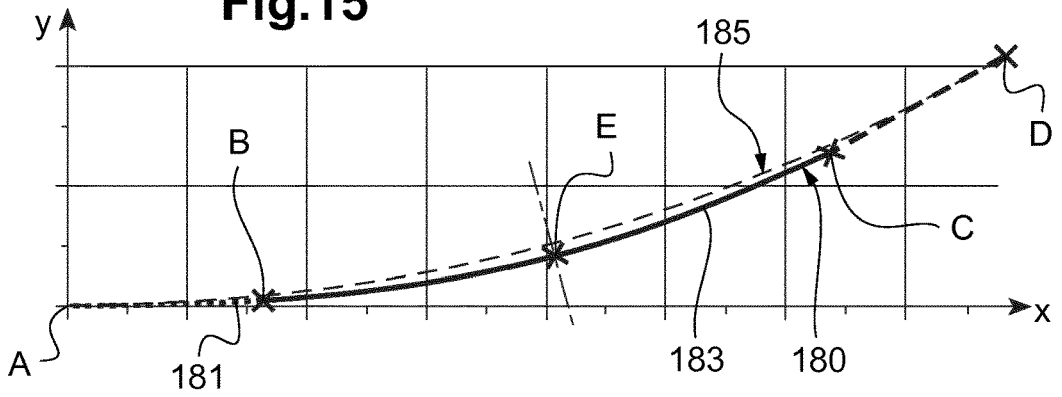
FIG. 15 is a graph showing the trajectory of a vehicle through the cornering structure in FIG. 1.

Reference is now made to FIG. 15.

A first curve 180 represents the trajectory of the center of inertia of a vehicle, for example the vehicle 200 described with reference to the preceding figures, through the corner. The x-axis corresponds to the general direction of the pathway upstream of the corner, at least in the vicinity of the corner. The y-axis is perpendicular to the x-axis in a horizontal plane.

This first curve 180 shows a first portion 181, from the reference A to the reference B, in the form of a portion of a clothoid corresponding to the trajectory of the vehicle on a corner entry section, and a second portion 182, from the reference C to the reference D, which is symmetrical to the first portion 181. This second portion corresponds to the trajectory of the vehicle on a corner exit section. Between the references B and C, a third portion 183, in the shape of an arc of a circle, corresponds to the trajectory of the vehicle on a connecting section of the corner, between the entry and exit sections. The reference E corresponds to the apex of the corner.

For comparison, a second curve 185 is shown by way of a dashed line representing a virtual trajectory in the shape of an arc of a circle for a similar corner (same entry point, same exit point).

Figure 16:
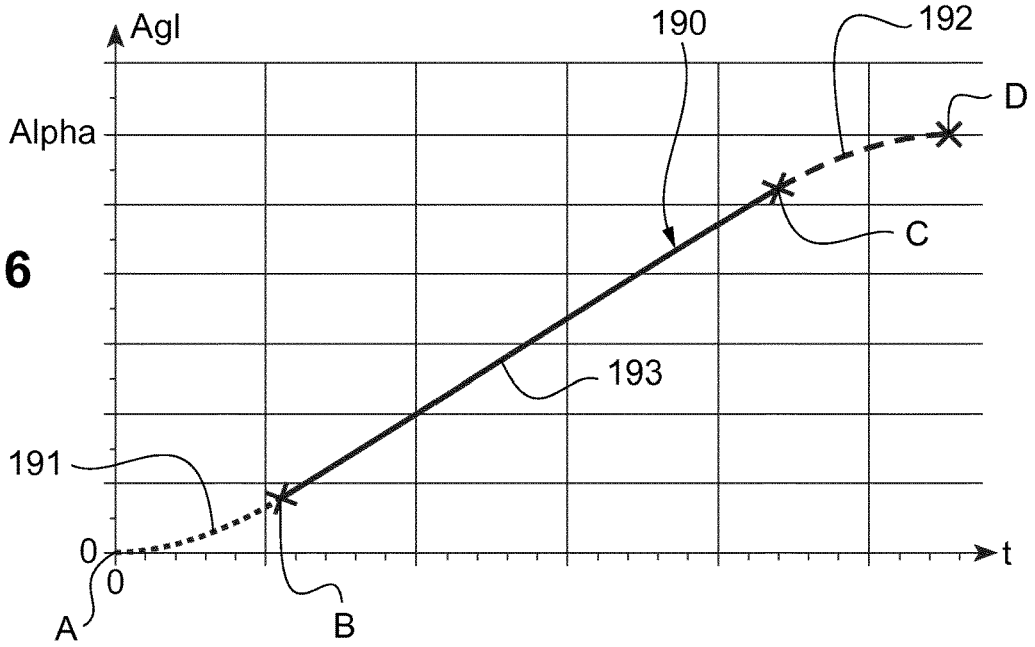
FIG. 16 is a graph showing how the angle of deflection of the vehicle changes over time through the cornering structure in FIG. 1.

Reference is now made to FIG. 16.

A third curve 190 therein shows how the angle of deflection Agl, expressed in degrees, of the center of gravity of the vehicle changes as a function of time t, expressed in seconds. In this case, the vehicle is travelling at a constant speed. This speed can be the nominal speed of the hauling cable or a reduced speed. By way of example, the value thereof is in the order of a few meters per second, typically comprised between 2 meters per second and 8 meters per second.

This third curve 190 comprises a first portion 191, from the reference A to the reference B, and a second portion 192, from the reference C to the reference D, which correspond respectively to the corner entry section and to the corner exit section. A third portion 193, from the reference B to the reference C, corresponds to the connecting section.

The angle of deflection Agl changes symmetrically over the first portion 191 and the second portion 192. Over the third portion 193, the angle of deflection Agl changes linearly. Such a change is characteristic of a trajectory in the shape of an arc of a circle described at a constant speed.

At the reference B, the angle of deflection reaches the value Alpha, which corresponds to the inclination of the pathways upstream and downstream of the corner relative to one another.

Figure 17:
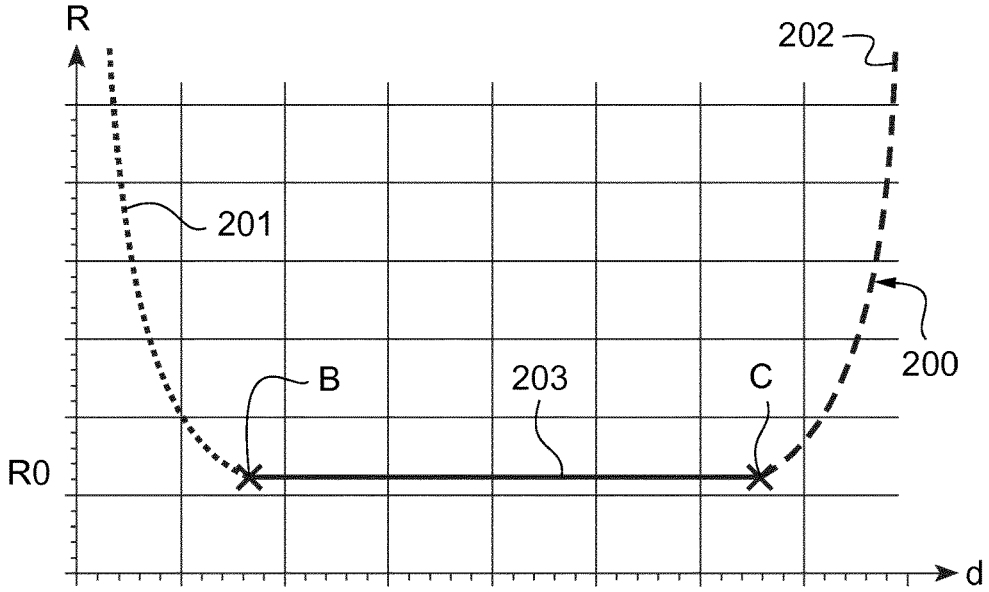
FIG. 17 is a graph showing how the radius of curvature of the trajectory of the vehicle changes over time through the cornering structure in FIG. 1.

Reference is now made to FIG. 17.

A fourth curve 200 therein shows how the radius of curvature R, expressed in meters, of the curved trajectory of the center of gravity of the vehicle, changes as a function of the distance d travelled from the entry to the corner, expressed in meters.

This fourth curve 200 comprises a first portion 201, up to the reference B, and a second portion 202, from the reference C, which correspond respectively to the corner entry section and the corner exit section. A third portion 203, from the reference B to the reference C, corresponds to the connecting section.

The absence of the reference A and of the reference B is noted, both of which are infinite, since the vehicle follows a rectilinear trajectory upstream and downstream of the corner. The first portion 201 and the second portion 202 show a property of a clothoid-shaped trajectory, which is to allow a continuous transition between an infinite radius of curvature and a finite radius value, in this case a value RO.

The third portion 203 shows a constant radius of curvature on the connecting section, characteristic of a trajectory in the shape of an arc of a circle. On this third portion 203, the radius of curvature is equal to the value RO, which corresponds to the radius of curvature at the end of the clothoid-shaped portion (first portion 201) and the beginning of the clothoid-shaped portion (second portion 202).

Figure 18:
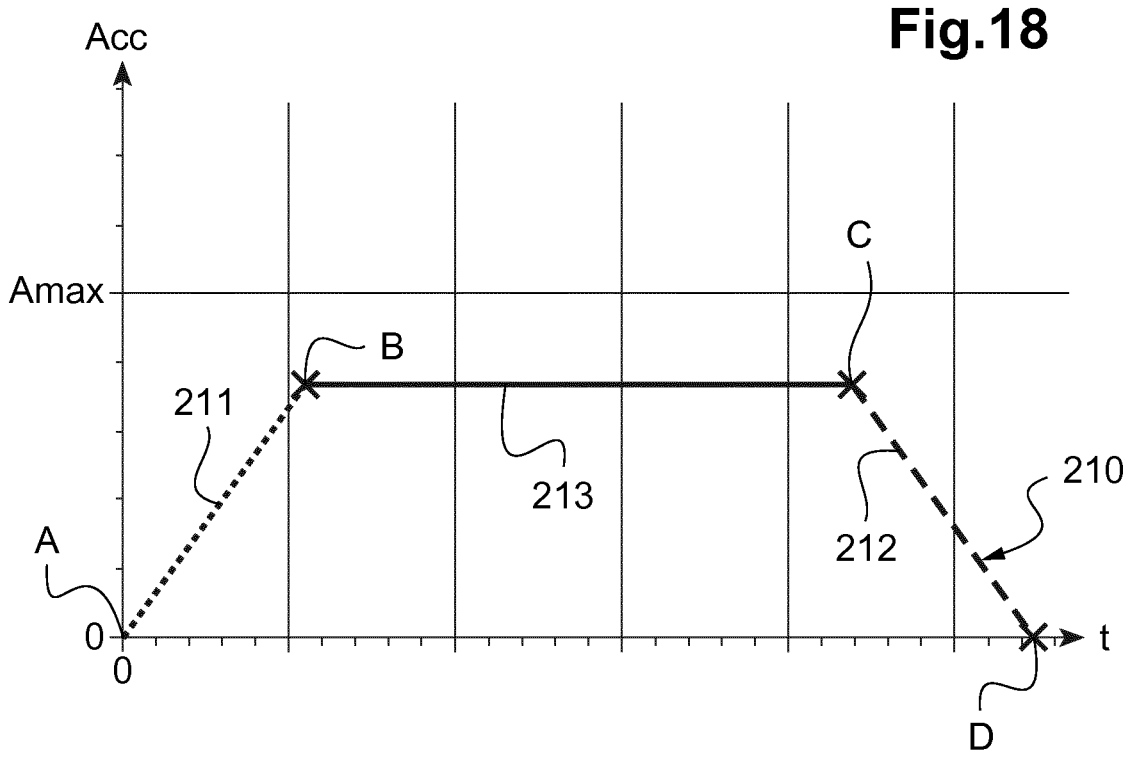
FIG. 18 is a graph showing how the lateral acceleration experienced by the center of gravity of the vehicle changes over time through the cornering structure in FIG. 1.
Figure 19:
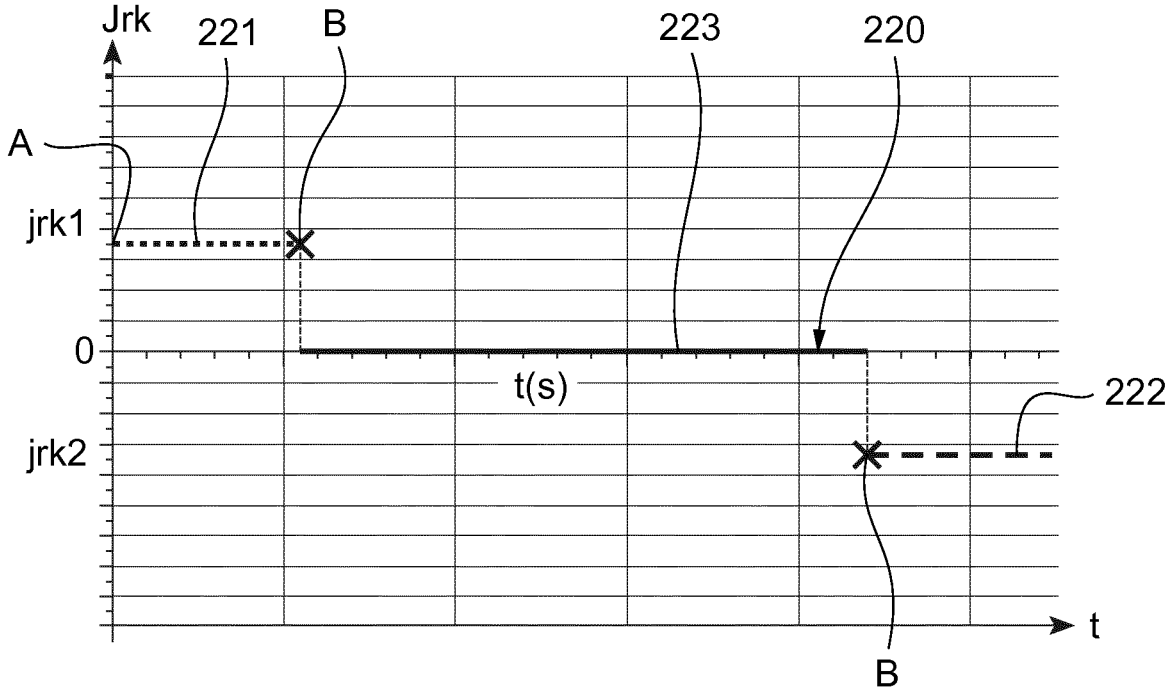
FIG. 19 is a graph showing how the jerk experienced by the center of gravity of the vehicle changes as a function of time through the cornering structure.

Reference is now made to FIG. 18.

A fifth curve 210 therein shows how the lateral acceleration Acc of the vehicle, expressed in g (9.8 meters per second squared), at the center of gravity of the vehicle changes as a function of time t, expressed in seconds, from the entry to the corner (reference A). The vehicle is travelling at a constant speed.

This fifth curve 210 comprises a first portion 211, from the reference A to the reference B, and a second portion 212, from the reference C to the reference D, which correspond respectively to the corner entry section and to the corner exit section. A third portion 213, from the reference B to the reference C, corresponds to the connecting section.

The first portion 211 and the second portion 212 show that on the clothoid-shaped portions, the vehicle undergoes an acceleration that is increasing, or respectively decreasing. The third portion 213 shows a constant acceleration Acc as the vehicle travels through the portion in the shape of an arc of a circle.

The lateral acceleration of the vehicle remains below a maximum acceleration value Amax through the corner. This value Amax results, for example, from requirements laid down by standards.

Reference is now made to FIG. 22.

A sixth curve 220 therein shows how the jerk Jrk changes over time, i.e. the time derivative of the lateral acceleration Acc, expressed in g per second (9.8 meters per second cubed), at the center of gravity of the vehicle, from the entry to the corner (reference A) to the exit thereof (reference D). The vehicle is travelling at a constant speed.

This sixth curve 220 comprises a first portion 221, from the reference A to the reference B, and a second portion 222, from the reference C to the reference D, which correspond respectively to the corner entrance section and to the corner exit section. A third portion 223, from the reference B to the reference C, corresponds to the connecting section.

The first portion 221 and the second portion 222 show that on the clothoid-shaped portions, the vehicle undergoes a constant jerk. The third portion 223 shows that the jerk is zero as the vehicle travels through the portion in the shape of an arc of a circle.

This constant jerk on the clothoid-shaped portions is particularly useful when dimensioning a cornering structure. It allows the standards for jerk or lateral acceleration limit values to be met, while remaining as close to these values as possible. This allows a cornering trajectory to be designed such that it can be travelled quickly, while still complying with the standards in force. This can also be seen as a way of optimizing the distance to be travelled to go from one rectilinear section to another rectilinear section, inclined horizontally relative to the first, for a given angle of inclination and a given vehicle travelling speed.

Theoretically at least, the section of trajectory in the shape of an arc of a circle, which connects the sections in the shape of portions of a clothoid, is optional. This section is nevertheless of interest in terms of the comfort of the vehicle's passengers. Advantageously, it can be designed in such a way that the constant value of lateral acceleration, reached on the intermediate portion 213 of the curve 210, corresponds to an acceleration limit value acceptable to the passengers, for example the value Amax.

FIGS. 15 to 17 also show that an intermediate pathway in the shape of an arc of a circle is useful for the implementation of the guide and rolling elements in the structure. Without this portion in the shape of an arc of a circle, the corner would be shorter, but there would be insufficient space for the rollers 502 of the guide elements 500 to retract, for example, since the latter must generally comply with a limit value for the basic angle of deflection of the hauling cable on each roller 502.

The description provided hereinabove relates to the case of a pathway deflection occurring in a generally horizontal plane, in particular when the pathway portion upstream of the corner and the pathway portion downstream of the corner are at substantially the same altitude. The vehicle is thus preferably guided in a plane, in particular a horizontal plane.

In some cases, it can be advantageous to raise or lower the altitude of the vehicle through the corner, for example when the transport pathway extends along a mountainside. The invention thus provides for the vehicle to be guided along a trajectory that is planar or not and which, when projected in a plane, for example a horizontal plane or a mean plane, follows a portion of a clothoid, at least in part.

A method for constructing this mean plane is now described.

Reference is now made to FIG. 20.

I.e. a curve 230 representing any corner in space.

Reference is now made to FIG. 21.

The curve 240 represents the corner corresponding to the curve 230 seen in elevation in a first vertical plane 242. A portion 244 can be distinguished therein which represents a vertical deflection section, or downstream end section, located in this first vertical plane 242. This first vertical plane 242 corresponds to the plane of the downstream cable span.

Reference is now made to FIG. 22.

The curve 250 represents the corner corresponding to the curve 230 seen in elevation in a second vertical plane 252. A portion 254 can be distinguished therein which represents an upstream vertical deflection section, or upstream end section, located in this second vertical plane 252. This second vertical plane 252 corresponds to the plane of the upstream cable span.

Reference is now made to FIG. 23.

The curve 260 represents the corner projected in a plane perpendicular to the z-axis, i.e. a horizontal plane.

A portion 262 can be distinguished between the reference I and the reference II, which represents a lateral deflection section, or central section. This section is located outside the projection plane. This section can be non-planar, or located in any plane.

The reference I references a point at the interface between the downstream end section and the central section. The reference II references a point at the interface between the central section and the upstream end section.

Reference is now made to FIG. 24.

For each upstream and downstream end section, starting from the point referenced I, respectively the point referenced II, a first horizontal line 270 can be drawn in the first vertical plane 242, respectively a second horizontal line 272 in the second vertical plane 252.

The first horizontal line 270 and the second horizontal line 272 do not intersect.

Reference is now made to FIG. 25.

A vertical segment 280 can be drawn which connects the first horizontal line 270 and the second horizontal line 272 to one another. The length of the vertical segment 280 represents the minimum geometric distance between the first horizontal line 270 and the second horizontal line 272. This distance represents the difference in height between the point referenced I and the point referenced II. This is the difference in height of the central section, in a way the difference in height of the corner.

Figure 26:
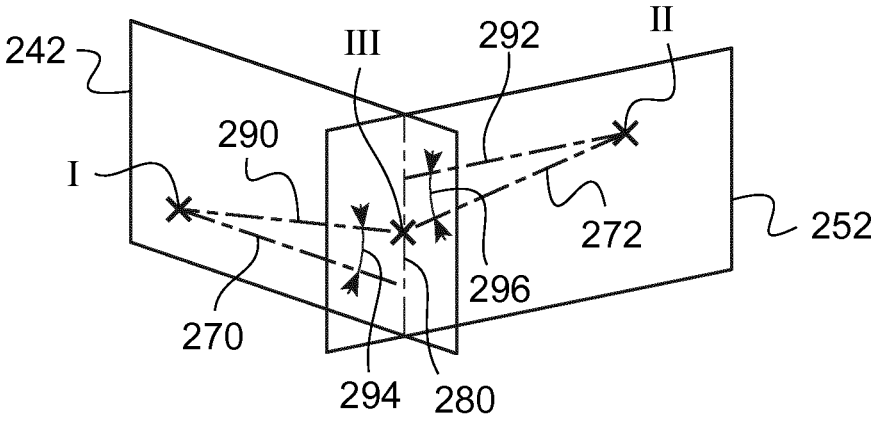

Reference is now made to FIG. 26.

The point referenced I and the point referenced II can be connected to one another by a first oblique line 290 in the first vertical plane 242 and a second oblique line 292 in the second vertical plane 252 such that a first angle 294 between the first oblique line 290 and the first horizontal line 270 is equal to a second angle 296 between the second oblique line 292 and the second horizontal line 272.

The first oblique line 290 and the second oblique line 292 intersect one another at a point (referenced III) on the vertical segment 280.

Figure 27:
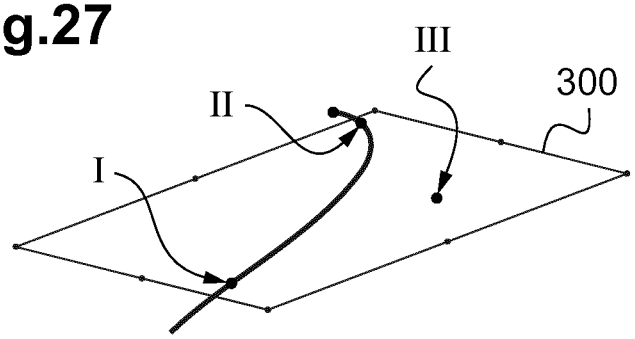
Figure 28:
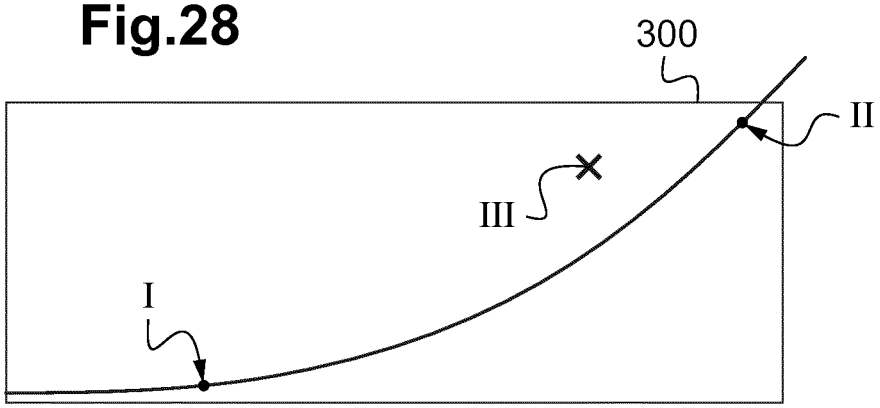

Reference is now made to FIGS. 27 and 28.

The mean plane 300 is defined as the plane passing through the points referenced I, II and II.

It is in this mean plane 300, or in a horizontal plane, that the lateral deflection section must be projected to check that this planar projection is at least partially shaped like a portion of a clothoid.

An aerial structure has been described which connects respectively to an upstream section and to a downstream section of an aerial cable transport line and comprises at least one lateral guidance system that is active on at least a portion of the line, between the entry and the exit, this portion extending generally according to a portion of a clothoid or of a pseudo-clothoid, at least projecting in a mean plane.

In the example embodiment described, it is the hauling cable that is guided along a profile in the shape of a portion of a clothoid. The track cables are guided along any profile, since between the entry and exit of the corner, the vehicles run on a track consisting of the outer and inner beams. What is important is that the center of gravity of the vehicle through the corner runs along carefully designed clothoid-shaped portions, which allow an infinite radius of curvature to be changed to a determined radius of curvature while respecting limit values for jerk and/or lateral acceleration. When the grip that connects the vehicle to the hauling cable is substantially in line with the center of inertia of this vehicle, this amounts to guiding this cable along portions of a clothoid. However, in the case of a lateral offset, this cable should be guided along a portion of a pseudo-clothoid, which is deduced from a theoretical curve of an orthogonal offset corresponding to the lateral offset between the grip and the center of gravity.

A guide has been described that acts on the carriage of the vehicle. Additionally or alternatively, a vehicle guidance system can be envisaged which acts solely by guiding the hauling cable. The guidance system in question can also act on the vehicle in the continuation of the upstream portions of the one or more track cables, for example by providing a lateral guidance system on the track.

A dual track cable system has been described, however the invention is immediately applicable to a single track cable system or to a single-cable system.

An aerial cornering structure supported by columns has been described. Alternatively, this could be integrated into a station, or suspended, without necessarily using columns.

In an alternative embodiment of the cornering structure described hereinabove, each vehicle disengages from the hauling cable on entering the corner, or upstream of this entry, and re-engages with this cable on exiting the corner, or downstream of this exit. For example, the grip or attachment of the vehicle is uncoupled from the hauling cable and then re-coupled to this hauling cable. The vehicle can be guided laterally through the corner in a similar way to that described hereinabove, in particular by means of a curved rail and/or outer and inner beams. The hauling cable can be deflected, at least laterally, through the corner, independently of the trajectory of the vehicle, along any profile.

Clothoid- or pseudo-clothoid-shaped portions have been described. A clothoid is characterized by a curvature that changes linearly with the curvilinear abscissa, in particular between a straight line and a given curvature value. It is also characterized by a radius of curvature that changes linearly with the inverse of this curvilinear abscissa. The portions in question can, more generally, be shaped like portions of any curve of the radioid family, or portion of a radioid in short, or of a pseudo-radioid. In radioids, the curvature, i.e. the inverse of the radius of curvature, varies continuously with the curvilinear abscissa, in particular between a straight line and a given curvature.

An aerial structure for a dual-cable type aerial cableway system has been described comprising at least one active vehicle guidance system for guiding, at least laterally, on at least a first portion of a curved intermediate section, this first portion generally extending along a portion of a radioid, or of a pseudo-radioid, at least projecting in the horizontal plane, or a mean plane containing this entry and this exit, in combination with at least one guidance system for the hauling cable, which is active between the entry and the exit, capable of deflecting this cable, at least laterally, on the first portion of the curved intermediate section, and with a guidance system for the one or more track cables, which is also active between the entry and the exit, and capable of deflecting this cable, at least laterally, over the first curved intermediate portion It will be understood that an invention exists insofar as these guidance systems for the hauling cable and the one or more track cables are combined with a curved running pathway section, regardless of the shape of this section. The aerial structure is thus distinguished from structures in which one or more first track cables are provided upstream of the curved intermediate section and one or more second track cables are provided downstream of this section, these cables being respectively anchored to the ground at the entry and exit of the structure. The drawback of this type of aerial structure is that it requires large and costly anchor blocks and foundations sized accordingly. Conversely, the forces that the cables apply to the structure remain localized at the apex of the structure, thus preventing the need for such anchors. The resultant of the forces exerted by the cables, directed along the radial axis of the curve described, is balanced by an optimized structural layout. The resulting occupied floor area is very small. Moreover, sliding of the one or more track cables along the longitudinal axis of the line is permitted, said sliding being made necessary by temperature variations and to increase the life of the cable.

In other words, another aspect of the invention relates to an aerial structure for an aerial cableway system of the type comprising a hauling cable and at least one track cable, the structure comprising an entry and an exit which connect respectively to a generally rectilinear upstream section and downstream section of a transport pathway of the aerial cableway system, the structure supporting a curved intermediate section, at least projecting in a horizontal plane of the transport pathway, between the entry and the exit, and further comprising at least one active vehicle guidance system for guiding, at least laterally, on at least part of the curved intermediate section, at least one guidance system for the hauling cable that is active between the entry and the exit and capable of deflecting this cable, at least laterally, on the part of the curved intermediate section, and at least one guidance system for the track cable guide that is active between the entry and the exit and capable of deflecting this cable, at least laterally, on this part of the curved intermediate section.

Optional, additional or alternative features of this aerial structure are set out below:

- the vehicle guidance system comprises a curved rail which extends at least partially over the relevant part of the curved intermediate section;
- the vehicles on the line are engaged in the curved rail between the entry and the exit;
- the structure further comprises a track for vehicles on the line that is active between the entry and the exit;
- at least a portion of this track extends generally along at least part of the curved intermediate section;
- the track comprises at least one beam which extends at least partially along the curved intermediate section;
- the track comprises at least one transition area with an upstream section of the track cable and/or a downstream section of this cable;
- the guidance system for the hauling cable comprises a plurality of elements, distributed along at least part of the curved intermediate section;
- at least some of the elements of the guidance system for the hauling cable retract on the passage of the vehicles on the line.

The invention further proposes an aerial cable transport system comprising at least one such structure.

The invention is not limited to the embodiments described hereinabove by way of example, however also encompasses any alternative embodiments that a person skilled in the art could consider.

The invention claimed is:

1. An aerial structure for an aerial cableway system of the type comprising at least one hauling cable, the structure comprising:

- an entry and an exit which are intended to be connected respectively to an upstream section and to a downstream section, each generally rectilinear, of a transport pathway of the aerial cableway system, as well as an intermediate section that is connected to the entry and to the exit, the intermediate section being curved, at least projecting in a horizontal plane, between the entry and the exit,
- at least one active vehicle guidance system for guiding, at least laterally, on at least a first portion of a guide rail of the curved intermediate section, said first portion generally extending along a portion of a radioid, or of a pseudo-radioid, at least projecting in the horizontal plane, or a mean plane which contains the entry and the exit,
- at least one hauling cable guidance system that is active between the entry and the exit and capable of deflecting said at least one hauling cable, at least laterally, between the entry and the exit, and
- a track for vehicles on a line, between the entry and the exit, wherein at least a portion of said track generally extends along a portion of a radioid or of a pseudo-radioid, at least projecting in the mean plane or the horizontal plane, on at least the first portion of the curved intermediate section such that the vehicles are disengaged from a track cable, at least in the proximity of the entry, to travel on the track and reengaged on the track cable, in the proximity of the exit.

2. The structure according to claim 1, wherein the at least one hauling cable guidance system is capable of guiding said at least one hauling cable along the first portion of the curved intermediate section.

3. The structure according to claim 1, wherein the at least one active vehicle guidance system further acts on at least a second portion of the curved intermediate section, and each of the first portion and the second portion generally extends according to a portion of a radioid, or of a pseudo-radioid, at least projecting in the mean plane or the horizontal plane.

4. The structure according to claim 3, wherein the at least one hauling cable guidance system is capable of guiding said at least one hauling cable along the second portion of the curved intermediate section.

5. The structure according to claim 3, wherein the first portion and the second portion of the intermediate section are separated from one another by an intermediate portion, and said intermediate portion extends along a portion of a circle, at least projecting in the mean plane or the horizontal plane, and said at least one hauling cable guidance system acts on said intermediate portion.

6. The structure according to claim 3, wherein the first portion and the second portion of the intermediate section generally extend symmetrically to one another.

7. The structure according to claim 1, wherein said first portion is located proximate to said entry.

8. The structure according to claim 1, further comprising at least one guidance system for guiding at least one track cable, that is active between the entry and the exit and capable of deflecting said track cable, at least laterally, between said entry and said exit.

9. The structure according to claim 8, wherein the at least one hauling cable guidance system is capable of deflecting said at least one track cable, at least laterally, along the first portion of the curved intermediate section.

10. The structure according to claim 1, wherein the at least one active vehicle guidance system comprises a curved rail which extends at least partially along a portion of a radioid or of a pseudo-radioid, at least projecting in the mean plane or the horizontal plane, on at least the first portion of the curved intermediate section, and vehicles on the line are engaged in the curved rail between the entry and the exit.

11. The structure according to claim 1, wherein the track comprises at least one beam which extends at least partially along a portion of a radioid or of a pseudo-radioid, at least projecting in the mean plane or the horizontal plane.

12. The structure according to claim 1, wherein the track comprises at least one transition area with an upstream section of at least one track cable and/or a downstream section of said at least one track cable.

13. The structure according to claim 12, wherein at least some of the elements of the guidance system for the hauling cable retract on passage of the vehicles on the line.

14. The structure according to claim 1, wherein the guidance system for the hauling cable comprises a plurality of elements, distributed along at least the first portion.

15. The structure according to claim 1, wherein said portion of a radioid or of a pseudo-radioid is a portion of a clothoid or of a pseudo-clothoid, respectively.

16. An aerial cable transport system comprising:

at least one aerial cable transport line including an upstream section and a downstream section, each of which extends in a generally rectilinear manner, at least projecting in a horizontal plane, and a structure according to claim 1, the entry and the exit whereof connect respectively to the upstream section and to the downstream section.

* * * * *